US010078276B2

(12) United States Patent
Tsurumi et al.

(10) Patent No.: US 10,078,276 B2
(45) Date of Patent: Sep. 18, 2018

(54) POSITIVELY CHARGEABLE SINGLE-LAYER ELECTROPHOTOGRAPHIC PHOTOSENSITIVE MEMBER, PROCESS CARTRIDGE, AND IMAGE FORMING APPARATUS

(71) Applicant: KYOCERA Document Solutions Inc., Osaka (JP)

(72) Inventors: Hiroki Tsurumi, Osaka (JP); Eiichi Miyamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/160,601

(22) Filed: May 20, 2016

(65) Prior Publication Data

US 2016/0349635 A1 Dec. 1, 2016

(30) Foreign Application Priority Data

May 26, 2015 (JP) ..... 2015-106442

(51) Int. Cl.
*G03G 5/06* (2006.01)
*G03G 21/18* (2006.01)
*G03G 15/02* (2006.01)

(52) U.S. Cl.
CPC ..... *G03G 5/0614* (2013.01); *G03G 5/0603* (2013.01); *G03G 5/0605* (2013.01); (Continued)

(58) Field of Classification Search
CPC .. G03G 5/0614; G03G 5/0609; G03G 5/0607; G03G 5/0603; G03G 5/0618; G03G 21/18; G03G 15/02; G03G 5/0605
See application file for complete search history.

(56) References Cited

U.S. PATENT DOCUMENTS 5,034,294 A * 7/1991 Go ..... C07C 205/45 430/58.85
6,593,047 B2 * 7/2003 Azuma ..... G03G 5/0564 430/56

(Continued)

FOREIGN PATENT DOCUMENTS

JP 2007210954 A * 8/2007
JP 2012-027139 A 2/2012
JP 2014106365 A * 6/2014
WO WO-2017109926 A1 * 6/2017 ..... G03G 5/05
WO WO-2017110300 A1 * 6/2017 ..... G03G 5/05

OTHER PUBLICATIONS

Borsenberger, P.M.; Weiss, D.S. Organic Photoreceptors for Imaging Systems. New York:Marcel-Dekker, Inc. (1993) pp. 6-9, 289-292.*

(Continued)

*Primary Examiner* — Christopher D Rodee
(74) *Attorney, Agent, or Firm* — Studebaker & Brackett PC

(57) ABSTRACT

A positively chargeable single-layer electrophotographic photosensitive member is used as an image bearing member in an image forming apparatus including a charging section configured to be in contact with the image bearing member to apply a voltage thereto. The positively chargeable single-layer electrophotographic photosensitive member includes a conductive substrate and a photosensitive layer. The photosensitive layer contains at least a charge generating material, a hole transport material, an electron transport material, and a binder resin. The hole transport material contains a triarylamine derivative represented by the following general formula (I). In general formula (I), $R_1$, $R_2$, m and n have the same meaning as $R_1$, $R_2$, m, and n defined in the description.

(Continued)

(I)

7 Claims, 8 Drawing Sheets

(52) U.S. Cl.
CPC ..... *G03G 5/0607* (2013.01); *G03G 5/0609* (2013.01); *G03G 5/0618* (2013.01); *G03G 5/0672* (2013.01); *G03G 21/18* (2013.01)

(56) References Cited

U.S. PATENT DOCUMENTS

| | | | | |
|---|---|---|---|---|
| 8,859,818 | B2 | 10/2014 | Nakamura et al. | |
| 9,436,105 | B2 * | 9/2016 | Okada | C07C 211/54 |
| 2003/0211413 | A1 * | 11/2003 | Lin | G03G 5/04 430/78 |
| 2006/0183044 | A1 * | 8/2006 | Kim | C07D 471/06 430/78 |
| 2008/0305418 | A1 * | 12/2008 | Hamasaki | G03G 5/0564 430/78 |
| 2009/0325096 | A1 * | 12/2009 | Wu | G03G 5/0535 430/58.85 |
| 2012/0022293 | A1 | 1/2012 | Nakamura et al. | |
| 2015/0378268 | A1 * | 12/2015 | Okada | C07C 211/54 430/73 |
| 2016/0062253 | A1 * | 3/2016 | Okada | G03G 5/04 430/56 |

OTHER PUBLICATIONS

Diamond, Arthur S (editor) Handbook of Imaging Materials. New York: Marcel-Dekker, Inc. (2002) pp. 145-164.*

English language machine translation of JP 2014-106365 (Jun. 2014).*

* cited by examiner

POSITIVELY CHARGEABLE SINGLE-LAYER ELECTROPHOTOGRAPHIC PHOTOSENSITIVE MEMBER, PROCESS CARTRIDGE, AND IMAGE FORMING APPARATUS

INCORPORATION BY REFERENCE

The present application claims priority under 35 U.S.C. § 119 to Japanese Patent Application No. 2015-106442, filed on May 26, 2015. The contents of this application are incorporated herein by reference in their entirety.

BACKGROUND

The present disclosure relates to a positively chargeable single-layer electrophotographic photosensitive member, a process cartridge, and an image forming apparatus.

An electrophotographic photosensitive member is used in an electrophotographic image forming apparatus. In general, an electrophotographic photosensitive member includes a photosensitive layer. The photosensitive layer can contain a charge generating material, a charge transport material (such as a hole transport material or an electron transport material), and a resin for binding these materials (a binder resin). Alternatively, the photosensitive layer may contain a charge transport material and a charge generating material, so as to attain, by one layer, both charge generating and charge transporting functions. Such an electrophotographic photosensitive member is designated as a single-layer electrophotographic photosensitive member.

As the hole transport material of an electrophotographic photosensitive member, for example, a tris(4-styrylphenyl) amine derivative is known.

SUMMARY

A positively chargeable single-layer electrophotographic photosensitive member of the present disclosure is used as an image bearing member in an image forming apparatus including a charging section configured to be in contact with the image bearing member to apply a voltage thereto. The positively chargeable single-layer electrophotographic photosensitive member includes a conductive substrate, and a photosensitive layer. The photosensitive layer at least contains a charge generating material, a hole transport material, an electron transport material, and a binder resin. The hole transport material contains a triarylamine derivative represented by the following general formula (I):

(I)

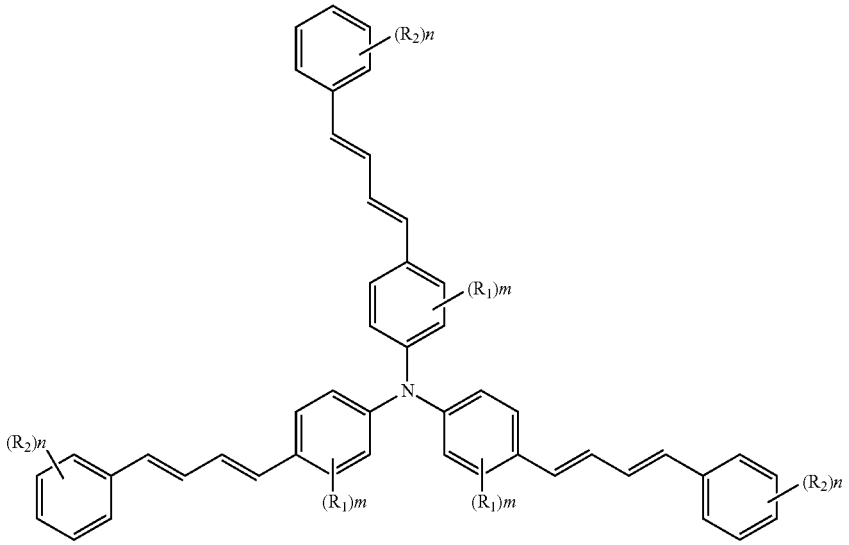

In general formula (I), $R_1$ and $R_2$ each independently represent a halogen atom, an optionally substituted alkyl group having a carbon number of at least 1 and no greater than 6, an optionally substituted alkoxy group having a carbon number of at least 1 and no greater than 6, or an optionally substituted aryl group having a carbon number of at least 6 and no greater than 12; m and n each independently represent an integer of 0 or more and 4 or less, and if m represents an integer of 2 or more, a plurality of $R_1$s present on the same aromatic ring may be the same as or different from one another, and if n represents an integer of 2 or more, a plurality of $R_2$s present on the same aromatic ring may be the same as or different from one another.

A process cartridge of the present disclosure includes the above-described positively chargeable single-layer electrophotographic photosensitive member.

An image forming apparatus of the present disclosure includes an image bearing member, a charging section, a light exposure section, a developing section, and a transfer section. The image bearing member corresponds to the above-described positively chargeable single-layer electrophotographic photosensitive member. The charging section charges a surface of the image bearing member. The charging section is configured to be in contact with the image bearing member to apply a voltage thereto. The charging section has a positive charging polarity. The light exposure section forms an electrostatic latent image on the surface of the image bearing member. The developing section develops the electrostatic latent image into a toner image. The transfer section transfers the toner image from the image bearing member onto a transfer target.

DETAILED DESCRIPTION

Figure 1A:
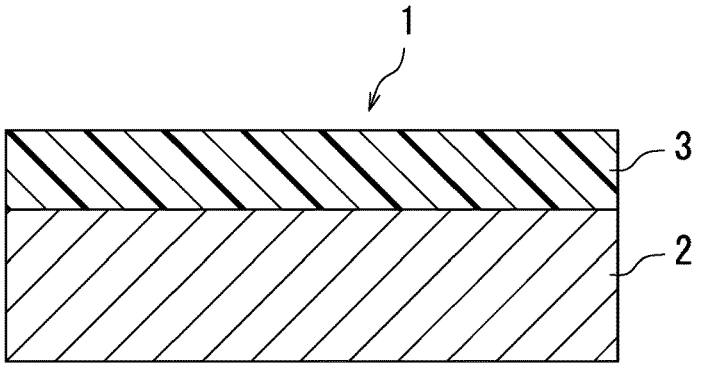
FIGS. 1A, 1B, and 1C are schematic cross-sectional views illustrating possible structures of a positively chargeable single-layer electrophotographic photosensitive member according to a first embodiment.

Preferred embodiments of the present disclosure will now be described in detail. It is noted that the present disclosure is not limited to the following embodiments but appropriate modifications and changes can be made within the scope of the object of the present disclosure. Incidentally, description is appropriately omitted in some cases where the description is redundant, which does not limit the gist of the present disclosure. It is noted that the term "-based" following the name of an organic compound is used in some cases for comprehensively referring to the organic compound and derivatives thereof.

Herein, a halogen atom, an alkyl group having a carbon number of at least 1 and no greater than 10, an alkyl group having a carbon number of at least 1 and no greater than 9, an alkyl group having a carbon number of at least 1 and no greater than 6, an alkyl group having a carbon number of at least 1 and no greater than 5, an alkyl group having a carbon number of at least 1 and no greater than 3, an alkoxy group having a carbon number of at least 1 and no greater than 10, an alkoxy group having a carbon number of at least 1 and no greater than 6, an alkoxy group having a carbon number of at least 1 and no greater than 4, an alkoxy group having a carbon number of at least 1 and no greater than 3, an aryl group having a carbon number of at least 6 and no greater than 14, an aralkyl group having a carbon number of at least 7 and no greater than 15, an aralkyl group having a carbon number of at least 7 and no greater than 12, a cycloalkyl group having a carbon number of at least 3 and no greater than 10, an alkenyl group having a carbon number of at least 2 and no greater than 10, alkenyl group having a carbon number of at least 2 and no greater than 6, an alkenyl group having a carbon number of at least 2 and no greater than 4, a heterocyclic group, an aliphatic acyl group having a carbon number of at least 2 and no greater than 4, and alkoxycarbonyl group having a carbon number of at least 2 and no greater than 5 are used respectively in the following meanings otherwise specified.

Examples of the halogen atom include a fluorine atom, a chlorine atom, a bromine atom and an iodine atom.

The alkyl group having a carbon number of at least 1 and no greater than 10 is a straight chain or branched chain, and unsubstituted group. Examples of the alkyl group having a carbon number of at least 1 and no greater than 10 include a methyl group, an ethyl group, an n-propyl group, an isopropyl group, an n-butyl group, a sec-butyl group, a tert-butyl group, an n-pentyl group, an isopentyl group, a neopentyl group, a hexyl group, a heptyl group, an octyl group, a nonyl group, and a decyl group.

The alkyl group having a carbon number of at least 1 and no greater than 9 is a straight chain or branched chain, and unsubstituted group. Examples of the alkyl group having a carbon number of at least 1 and no greater than 9 include a methyl group, an ethyl group, an n-propyl group, an isopropyl group, an n-butyl group, a sec-butyl group, a tert-butyl group, an n-pentyl group, an isopentyl group, a neopentyl group, a hexyl group, a heptyl group, an octyl group, and a nonyl group.

The alkyl group having a carbon number of at least 1 and no greater than 6 is a straight chain or branched chain, and unsubstituted group. Examples of the alkyl group having a carbon number of at least 1 and no greater than 6 include a methyl group, an ethyl group, an n-propyl group, an isopropyl group, an n-butyl group, a sec-butyl group, a tert-butyl group, an n-pentyl group, an isopentyl group, a neopentyl group, and a hexyl group.

The alkyl group having a carbon number of at least 1 and no greater than 5 is a straight chain or branched chain, and unsubstituted group. Examples of the alkyl group having a carbon number of at least 1 and no greater than 5 include a methyl group, an ethyl group, an n-propyl group, an isopropyl group, an n-butyl group, a sec-butyl group, a tert-butyl group, an n-pentyl group, an isopentyl group, and a neopentyl group.

The alkyl group having a carbon number of at least 1 and no greater than 3 is a straight chain or branched chain, and unsubstituted group. Examples of the alkyl group having a carbon number of at least 1 and no greater than 3 include a methyl group, an ethyl group, an n-propyl group, and an isopropyl group.

The alkoxy group having a carbon number of at least 1 and no greater than 10 is a straight chain or branched chain, and unsubstituted group. Examples of the alkoxy group having a carbon number of at least 1 and no greater than 10 include a methoxy group, an ethoxy group, an n-propoxy group, an isopropoxy group, an n-butoxy group, a sec-butoxy group, a tert-butoxy group, an n-pentyloxy group, an isopentyloxy group, a neopentyloxy group, a hexyloxy group, a heptyloxy group, an octyloxy group, a nonyloxy group, and a decyloxy group.

The alkoxy group having a carbon number of at least 1 and no greater than 6 is a straight chain or branched chain, and unsubstituted group. Examples of the alkoxy group having a carbon number of at least 1 and no greater than 6 include a methoxy group, an ethoxy group, an n-propoxy group, an isopropoxy group, an n-butoxy group, a sec-butoxy group, an n-pentyloxy group, an isopentyloxy group, a neopentyloxy group, and a hexyloxy group.

The alkoxy group having a carbon number of at least 1 and no greater than 4 is a straight chain or branched chain, and unsubstituted group. Examples of the alkoxy group having a carbon number of at least 1 and no greater than 4 include a methoxy group, an ethoxy group, an n-propoxy group, an isopropoxy group, an n-butoxy group, a sec-butoxy group, and a tert-butoxy group.

The alkoxy group having a carbon number of at least 1 and no greater than 3 is a straight chain or branched chain, and unsubstituted group. Examples of the alkoxy group having a carbon number of at least 1 and no greater than 3 include a methoxy group, an ethoxy group, an n-propoxy group, and an isopropoxy group.

The aryl group having a carbon number of at least 6 and no greater than 14 is, for example, an unsubstituted aromatic monocyclic hydrocarbon group having a carbon number of at least 6 and no greater than 14, an unsubstituted aromatic fused bicyclic hydrocarbon group having a carbon number of at least 6 and no greater than 14, or an unsubstituted aromatic fused tricyclic hydrocarbon group having a carbon number of at least 6 and no greater than 14. Examples of the aryl group having a carbon number of at least 6 and no greater than 14 include a phenyl group, a naphthyl group, an anthryl group, and a phenanthryl group.

The aralkyl group having a carbon number of at least 7 and no greater than 15 is an unsubstituted group. The aralkyl group having a carbon number of at least 7 and no greater than 15 is a group obtained through bonding of an aryl group having a carbon number of at least 6 and no greater than 14 with an alkyl group having a carbon number of at least 1 and no greater than 9.

The aralkyl group having a carbon number of at least 7 and no greater than 12 is an unsubstituted group. Examples of the aralkyl group having a carbon number of at least 7 and no greater than 12 include a group obtained through bonding of a phenyl group with an alkyl group having a carbon number of at least 1 and no greater than 6, and a group obtained through bonding of a naphthyl group with a methyl group or an ethyl group.

The cycloalkyl group having a carbon number of at least 3 and no greater than 10 is an unsubstituted group. Examples of the cycloalkyl group having a carbon number of at least 3 and no greater than 10 include a cyclopropyl group, a cyclobutyl group, a cyclopentyl group, a cyclohexyl group, a cycloheptyl group, a cyclooctyl group, a cyclononyl group, and a cyclodecyl group.

The alkenyl group having a carbon number of at least 2 and no greater than 10 is a straight chain or branched chain, and unsubstituted group. Examples of the alkenyl group having a carbon number of at least 2 and no greater than 10 include an ethenyl group, a propenyl group, a butenyl group, a pentenyl group, a hexenyl group, a heptenyl group, an octenyl group, a nonenyl group, and a decenyl group.

The alkenyl group having a carbon number of at least 2 and no greater than 6 is a straight chain or branched chain, and unsubstituted group. Examples of the alkenyl group having a carbon number of at least 2 and no greater than 6 include an ethenyl group, a propenyl group, a butenyl group, a pentenyl group, and a hexenyl group.

The alkenyl group having a carbon number of at least 2 and no greater than 4 is a straight chain or branched chain, and unsubstituted group. Examples of the alkenyl group having a carbon number of at least 2 and no greater than 4 include an ethenyl group, a propenyl group, and a butenyl group.

The heterocyclic group is an unsubstituted group. Examples of the heterocyclic group include a heterocyclic group having an aromatic 5- or 6-membered monocyclic ring containing 1 or more (preferably, at least 1 and no greater than 3) heteroatoms; a heterocyclic group obtained by fusing such monocyclic rings; and a heterocyclic group obtained by fusing such a monocyclic ring with a 5- or 6-membered hydrocarbon ring. The heteroatom is one or more selected from the group consisting of a nitrogen atom, a sulfur atom and an oxygen atom. Specific examples of the heterocyclic group include a thiophenyl group, a furanyl group, a pyrrolyl group, an imidazolyl group, a pyrazolyl group, an isothiazolyl group, an isoxazolyl group, an oxazolyl group, a thiazolyl group, a furazanyl group, a pyranyl group, a pyridyl group, a pyridazinyl group, a pyrimidinyl group, a pyrazinyl group, an indolyl group, a 1H-indazolyl group, an isoindolyl group, a chromenyl group, a quinolinyl group, an isoquinolinyl group, a purinyl group, a pteridinyl group, a triazolyl group, a tetrazolyl group, a 4H-quinolidinyl group, a naphthyridinyl group, a benzofuranyl group, a 1,3-benzodioxolyl group, a benzoxazolyl group, a benzothiazolyl group, and a benzimidazolyl group.

The aliphatic acyl group having a carbon number of at least 2 and no greater than 4 is a straight chain or branched chain, and unsubstituted group. The aliphatic acyl group having a carbon number of at least 2 and no greater than 4 is an acyl group obtained through bonding of an alkyl group having a carbon number of at least 1 and no greater than 3 with a carbonyl group. Examples of the aliphatic acyl group having a carbon number of at least 2 and no greater than 4 include a methyl carbonyl group (an acetyl group), an ethyl carbonyl group (a propionyl group), and a propyl carbonyl group.

The alkoxycarbonyl group having a carbon number of at least 2 and no greater than 5 is a straight chain or branched chain, and unsubstituted group. The alkoxycarbonyl group having a carbon number of at least 2 and no greater than 5 is an ester group obtained through bonding of an alkoxy group having a carbon number of at least 1 and no greater than 4 with a carbonyl group. Examples of the alkoxycarbonyl group having a carbon number of at least 2 and no greater than 5 include a methoxycarbonyl group, an ethoxycarbonyl group, a propoxycarbonyl group, and a butoxycarbonyl group.

Figure 1B:
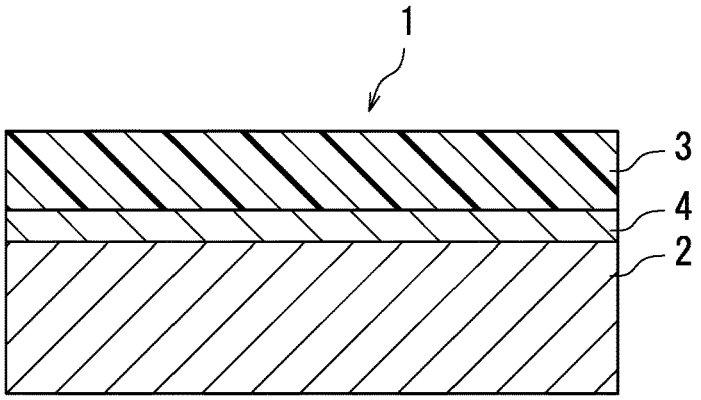
Figure 1C:
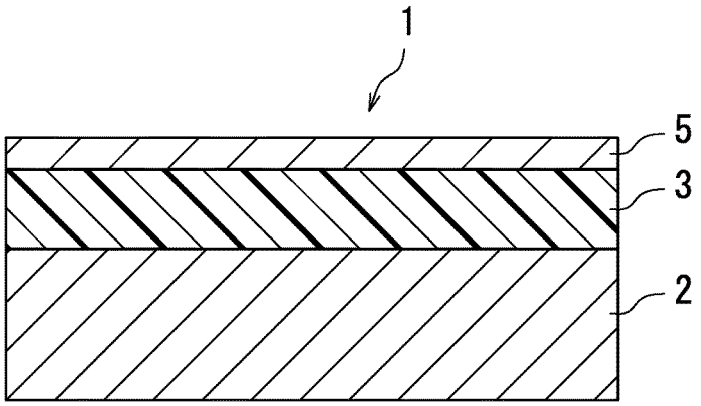
Figure 2:
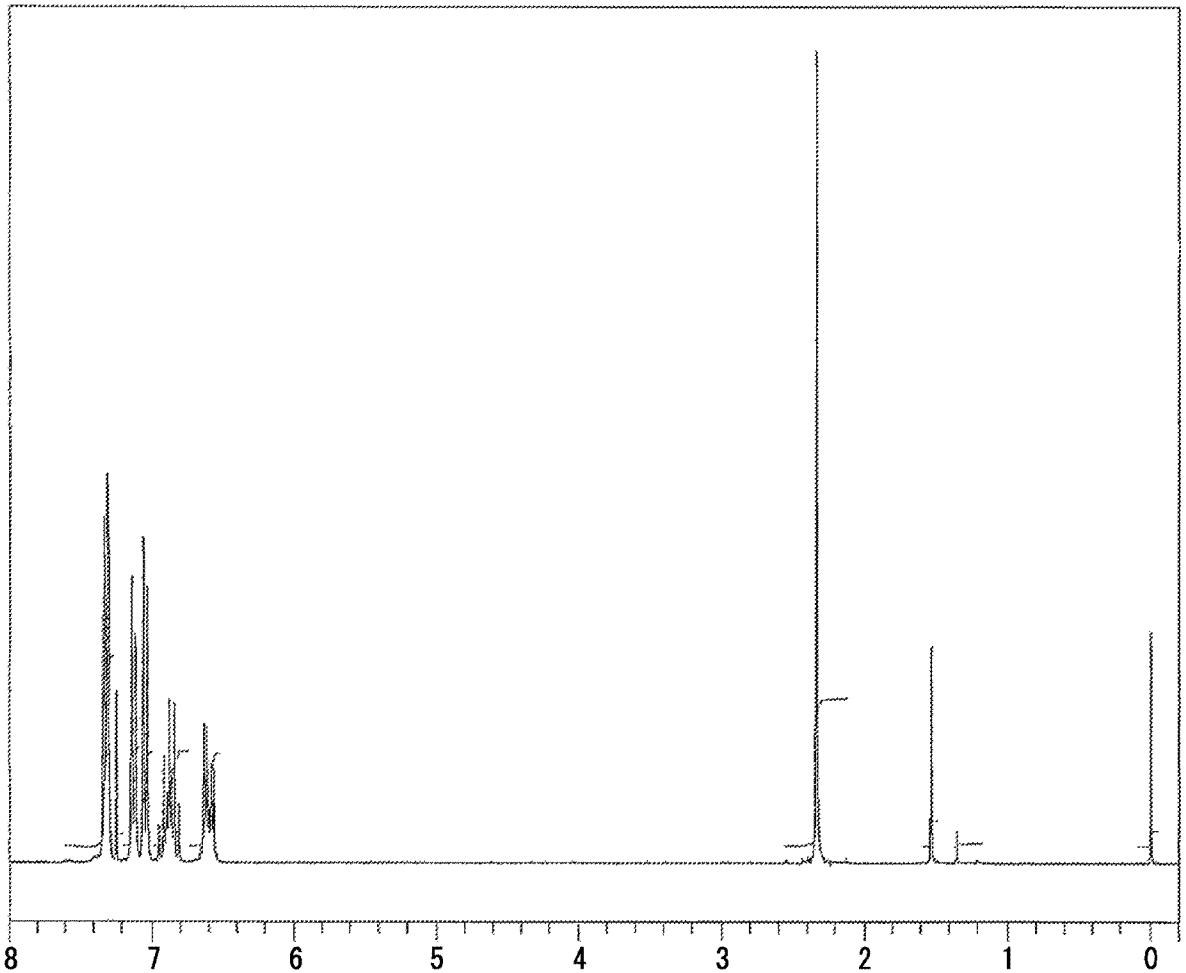
FIG. 2 is a $^{1}$H-NMR chart of a triarylamine derivative represented by chemical formula (HT-1).
Figure 3:
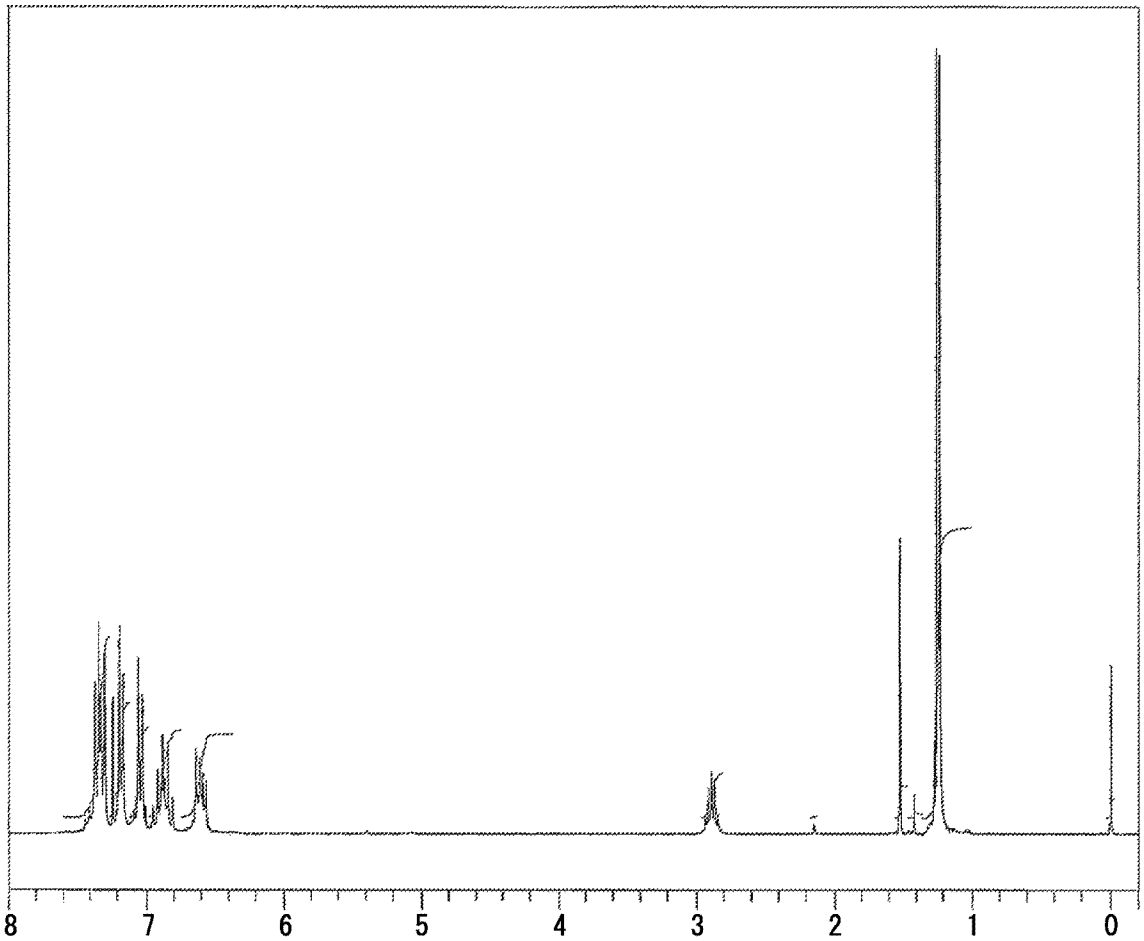
FIG. 3 is a $^{1}$H-NMR chart of a triarylamine derivative represented by chemical formula (HT-2).
Figure 4:
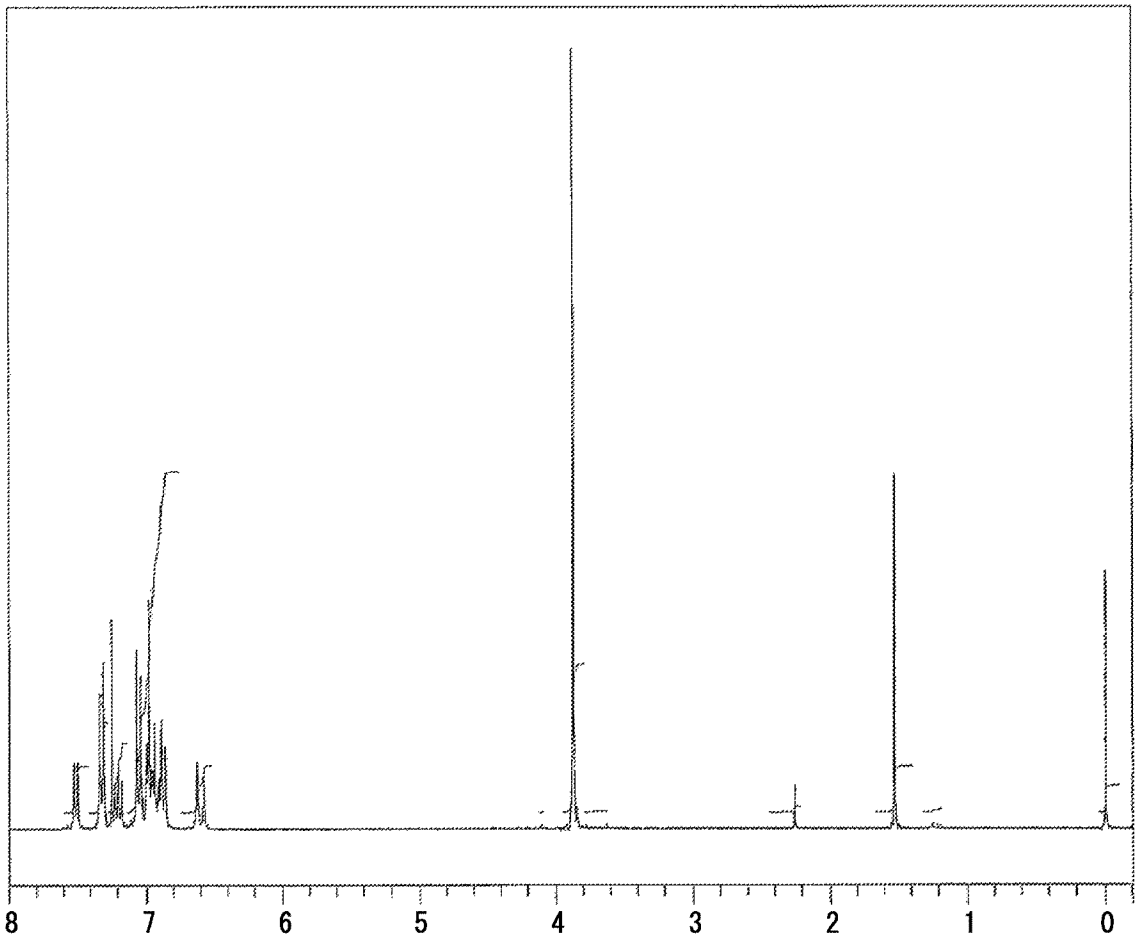
FIG. 4 is a $^{1}$H-NMR chart of a triarylamine derivative represented by chemical formula (HT-3).
Figure 5:
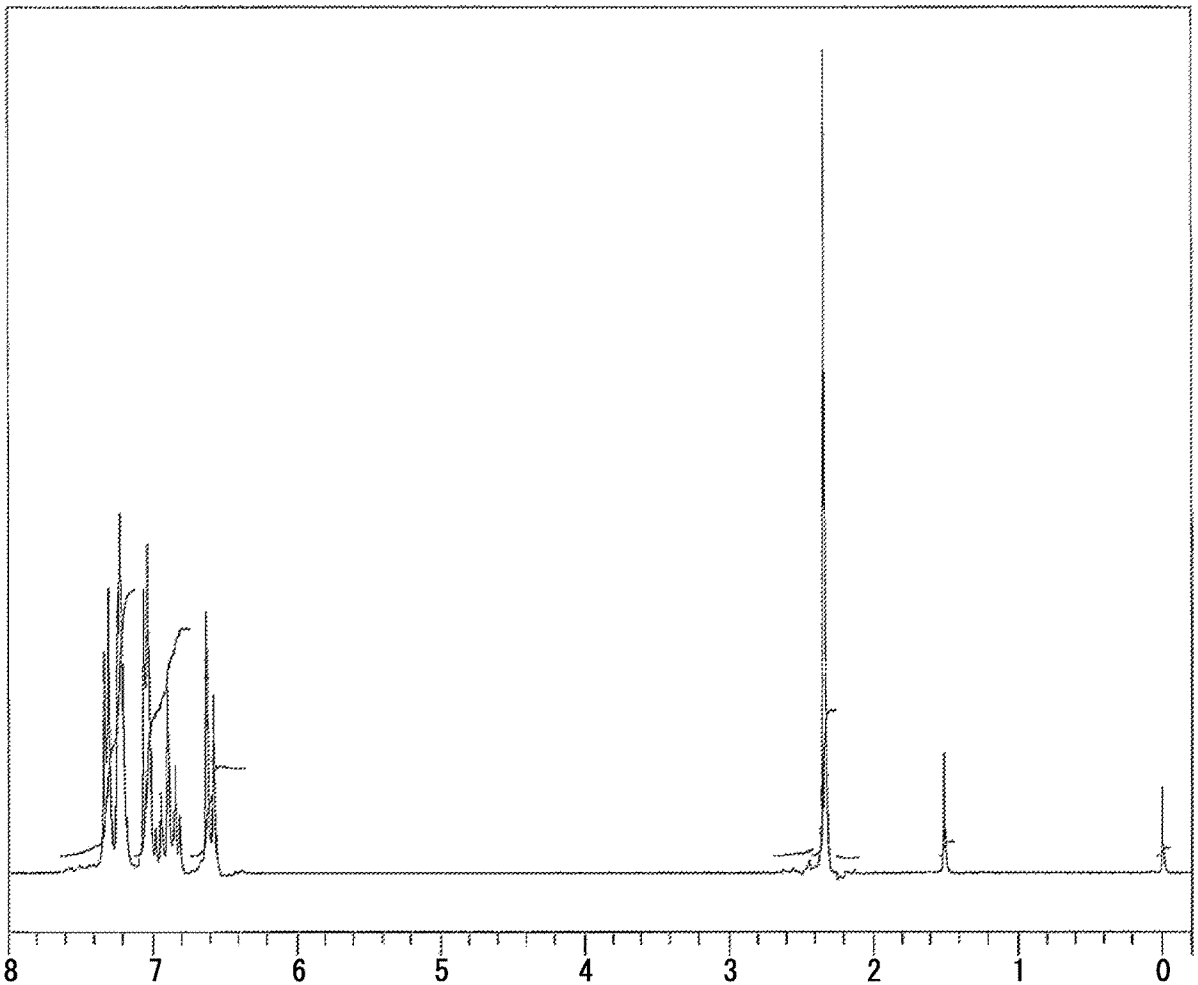
FIG. 5 is a $^{1}$H-NMR chart of a triarylamine derivative represented by chemical formula (HT-4).
Figure 6:
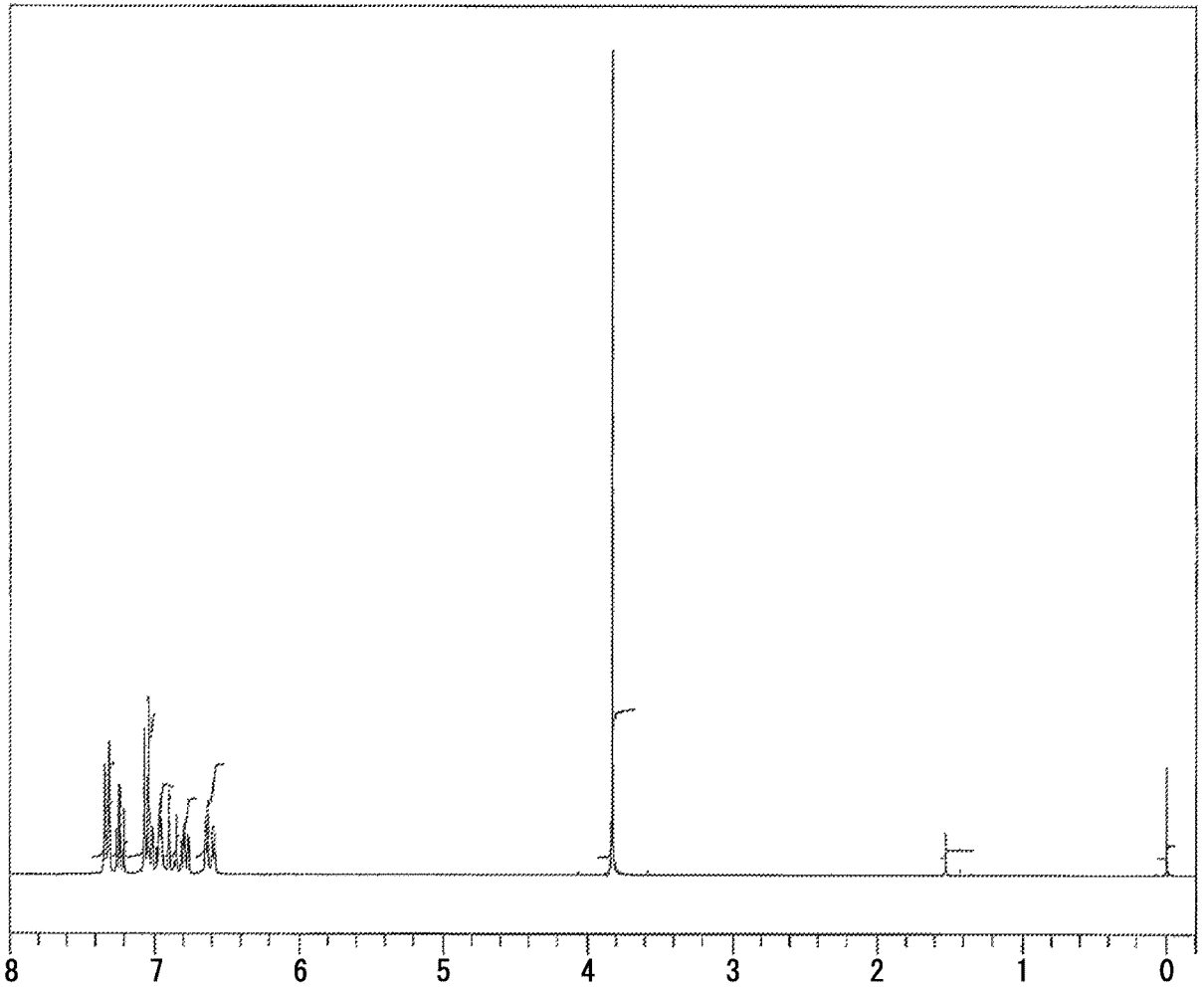
FIG. 6 is a $^{1}$H-NMR chart of a triarylamine derivative represented by chemical formula (HT-5).

First Embodiment: Positively Chargeable Single-Layer Electrophotographic Photosensitive Member A first embodiment relates to a positively chargeable single-layer electrophotographic photosensitive member (hereinafter sometimes simply referred to as the photosensitive member). Referring to FIGS. 1A to 1C, the photosensitive member of the first embodiment will be described. FIGS. 1A to 1C are schematic cross-sectional views illustrating possible structures of the positively chargeable single-layer electrophotographic photosensitive member of the first embodiment. The photosensitive member 1 includes, for example, a conductive substrate 2 and a photosensitive layer 3 as illustrated in FIG. 1A. The photosensitive layer 3 contains at least a charge generating material, a hole transport material, an electron transport material, and a binder resin. The photosensitive layer 3 contains, as the hole transport material, a triarylamine derivative represented by general formula (I) (hereinafter sometimes referred to as the triarylamine derivative (I)).

The photosensitive member 1 of the first embodiment can inhibit the occurrence of transfer memory. The reason is presumed as follows:

For convenience, the transfer memory will be first described. In electrophotographic image formation, an image forming process including, for example, the following steps 1) to 5) is practiced:

1) A charging step of charging a surface of an image bearing member;

2) a light exposure step of forming an electrostatic latent image on the surface of the image bearing member;

3) a developing step of developing the electrostatic latent image into a toner image;

4) a transferring step of transferring the formed toner image from the image bearing member onto a recording medium; and 5) a step of fixing, by heating, the tonner image having been transferred onto the recording medium.

In the above-described image forming process, however, the image bearing member is rotated in use, and hence, the transfer memory due to the transferring step may occur in some cases. Specifically, the transfer memory occurs as follows: In the charging step, the surface of the image bearing member is uniformly charged to a prescribed positive potential. Subsequently, after the light exposure step and the developing step, a transfer bias with a polarity opposite to the charging polarity (namely, a negative polarity) is applied in the transferring step to the image bearing member via the recording medium. Owing to the influence of the applied transfer bias, the potential of an unexposed region (a non-image-formed portion) on the surface of the image bearing member is largely lowered, and the potential lowered state is retained in some cases. Owing to the influence of this potential lowering, the unexposed region is difficult to be charged to a desired positive potential in the charging step of the next rotation. On the other hand, even while the transfer bias is being applied, the potential of an exposed region (an image-formed portion) is difficult to lower because a toner has attached to the exposed region and hence the transfer bias is difficult to be directly applied to the surface of the photosensitive member. Therefore, the exposed region is easily charged to a desired positive potential in the charging step of the next rotation. As a result, the charge potential becomes different between the exposed region and the unexposed region, so that the surface of the image bearing member is difficult to be uniformly charged to a prescribed positive potential in some cases. Such a phenomenon where the chargeability of an unexposed region is lowered to cause a potential difference due to the influence of transfer performed during image formation of a previous rotation of a photosensitive member is designated as the transfer memory.

As described above, the photosensitive member 1 of the first embodiment contains the triarylamine derivative (I) as the hole transport material. The triarylamine derivative (I) has three phenylbutadienyl groups. Owing to such a structure, the triarylamine derivative (I) tends to be excellent in compatibility with a binder resin. Accordingly, the triarylamine derivative (I) used as the hole transport material can be homogeneously dispersed in the photosensitive layer 3.

The triarylamine derivative (I) is homogeneously dispersed in the photosensitive layer 3. Therefore, the photosensitive member 1 tends to be excellent in electron mobility. The triarylamine derivative (I) is excellent in the dispersibility in the binder resin. The electron transport material and the triarylamine derivative (I) are both mixedly present in the photosensitive layer 3. Therefore, in the photosensitive layer 3, the compatibility between the electron transport material and the binder resin is improved, so as to easily improve the electron transporting property of the photosensitive layer 3. As a result, even while the transfer bias is being applied to the photosensitive member 1, electrons rapidly move in the photosensitive layer 3 and are difficult to remain in the photosensitive layer 3. Accordingly, the photosensitive member 1 of the first embodiment can inhibit the occurrence of the transfer memory. Incidentally, the description is given above on the assumption of an image forming apparatus not employing an intermediate transfer member. Also in an image forming apparatus employing an intermediate transfer member, the photosensitive member 1 of the first embodiment can similarly inhibit the occurrence of the transfer memory.

Subsequently, the photosensitive member 1 of the first embodiment will be described. The photosensitive member 1 includes, as illustrated in FIG. 1B, a conductive substrate 2, a photosensitive layer 3, and an intermediate layer 4. Alternatively, the photosensitive member 1 includes, as illustrated in FIG. 1C, a conductive substrate 2, a photosensitive layer 3, and a protective layer 5. The photosensitive layer 3 may be provided directly or indirectly on the conductive substrate 2. For example, the photosensitive layer 3 may be directly provided on the conductive substrate 2 as illustrated in FIG. 1A. Alternatively, the intermediate layer 4 may be appropriately provided between the conductive substrate 2 and the photosensitive layer 3 as illustrated in FIG. 1B. Besides, the photosensitive layer 3 may be exposed as an outermost layer as illustrated in FIGS. 1A and 1B. Alternatively, the protective layer 5 may be appropriately provided on the photosensitive layer 3 as illustrated in FIG. 1C.

The thickness of the photosensitive layer is not especially limited as long as it can sufficiently work as a photosensitive layer. The thickness of the photosensitive layer is preferably 5 μm or more and 100 μm or less, and more preferably 10 μm or more and 50 μm or less.

Now, the conductive substrate and the photosensitive layer will be described. Thereafter, the intermediate layer and a method for manufacturing the photosensitive member will be described.

[1. Conductive Substrate]

The conductive substrate is not especially limited as long as it can be used as a conductive substrate for a photosensitive member. As the conductive substrate, a conductive substrate having at least a surface portion made of a conductive material can be used. Examples of the conductive substrate include a conductive substrate made of a conductive material, and a conductive substrate coated with a conductive material. Examples of the conductive material include aluminum, iron, copper, tin, platinum, silver, vanadium, molybdenum, chromium, cadmium, titanium, nickel, palladium, and indium. One of these conductive materials may be singly used, or two or more of these may be used in combination. As the combination of two or more of these materials, for example, an alloy (specific examples include aluminum alloy, stainless steel, and brass) may be used. Among these conductive materials, aluminum or an aluminum alloy is preferably used as the material of the conductive substrate because charge is thus excellently transferred from the photosensitive layer to the conductive substrate.

The shape of the conductive substrate can be appropriately selected in accordance with the structure of an image forming apparatus to be used. For example, a sheet-shaped conductive substrate or a drum-shaped conductive substrate can be used. Besides, the thickness of the conductive substrate can be appropriately selected in accordance with the shape of the conductive substrate.

[2. Photosensitive Layer]

As described above, the photosensitive layer contains at least the charge generating material, the hole transport material, the electron transport material, and the binder resin. The photosensitive layer may further contain an additive if necessary. The charge generating material, the hole transport material, the electron transport material, and the binder resin will now be described. Besides, the additive will be also described.

[2-1. Charge Generating Material]

The charge generating material is not especially limited as long as it is a charge generating material for a photosensitive member. Examples of the charge generating material include phthalocyanine-based pigments, perylene pigments, bisazo pigments, dithioketopyrrolopyrrole pigments, metal-free naphthalocyanine pigments, metal naphthalocyanine pigments, squaraine pigments, trisazo pigments, indigo pigments, azulenium pigments, cyanine pigments, powders of inorganic photoconductive materials such as selenium, selenium-tellurium, selenium-arsenic, cadmium sulfide, and amorphous silicon, pyrylium salts, anthenthrone-based pigments, triphenylmethane-based pigments, threne-based pigments, toluidine-based pigments, pyrazoline-based pigments, and quinacridone-based pigments. Examples of the phthalocyanine-based pigments include metal-free phthalocyanine (such as X-form metal-free phthalocyanine ($X—H_2Pc$)), and a metal phthalocyanine derivative. Examples of the metal phthalocyanine derivative include titanyl phthalocyanine (TiOPc), and metal phthalocyanine in which a metal other than titanium oxide is coordinated (such as V-form hydroxygallium phthalocyanine). As for the crystal form of titanyl phthalocyanine, for example, α-form titanyl phthalocyanine, β-form titanyl phthalocyanine, or Y-form titanyl phthalocyanine may be used. Among these charge generating materials, a phthalocyanine-based pigment is preferred, and metal-free phthalocyanine or metal phthalocyanine is more preferred as the charge generating material for a photosensitive member. X-form metal-free phthalocyanine or titanyl phthalocyanine is further preferred. One of these charge generating materials may be singly used, or two or more of these may be used in combination.

A charge generating material having an absorption wavelength in a desired region may be singly used in the photosensitive member, or two or more charge generating materials may be used in combination in the photosensitive member. Besides, for example, in a digital optical image forming apparatus (such as a laser beam printer or a facsimile machine using a light source of a semiconductor laser or the like), a photosensitive member having sensitivity in a wavelength region of 700 nm or higher is preferably used. Therefore, for example, a phthalocyanine-based pigment (such as X-form metal-free phthalocyanine, or Y-form titanyl phthalocyanine) is suitably used. The crystal structure (of, for example, α-form, β-form, or Y-form) of the phthalocyanine-based pigment is not especially limited, and any of phthalocyanine-based pigments having various crystal structures can be used.

In a photosensitive member to be applied to an image forming apparatus using a short wavelength laser light source, an anthenthrone-based pigment or a perylene-based pigment is suitably used as the charge generating material. The wavelength of a short wavelength laser is a wavelength of about 350 nm or longer and 550 nm or shorter.

The content of the charge generating material is preferably 0.1 part by mass or more and 50 parts by mass or less, and more preferably 0.5 part by mass or more and 30 parts by mass or less based on 100 parts by mass of the binder resin in the photosensitive layer.

[2-2. Hole Transport Material]

The triarylamine derivative (I) contained in the photosensitive layer as the hole transport material is represented by general formula (I):

(I)

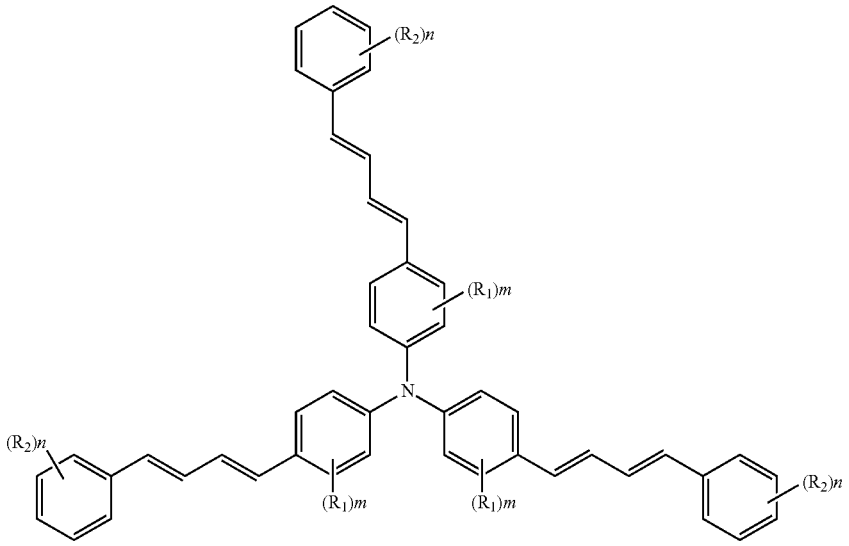

In general formula (I), $R_1$ and $R_2$ each independently represent a halogen atom, an optionally substituted alkyl group having a carbon number of at least 1 and no greater than 6, an optionally substituted alkoxy group having a carbon number of at least 1 and no greater than 6, or an optionally substituted aryl group having a carbon number of at least 6 and no greater than 14; m and n each independently represent an integer of 0 or more and 4 or less, and if m represents an integer of 2 or more, a plurality of $R_1$s present on the same aromatic ring may be the same as or different from one another, and if n represents an integer of 2 or more, a plurality of $R_2$s present on the same aromatic ring may be the same as or different from one another.

As described above, the triarylamine derivative (I) tends to be excellent in the dispersibility in the photosensitive layer. Therefore, there is a tendency that the triarylamine derivative (I) can inhibit crystallization in forming the photosensitive layer. As a result, if the photosensitive member includes the photosensitive layer, the photosensitive member attains excellent sensitivity.

The alkyl group having a carbon number of at least 1 and no greater than 6 represented by $R_1$ or $R_2$ in general formula (I) is preferably an alkyl group having a carbon number of at least 1 and no greater than 3, and is more preferably a methyl group or an isopropyl group. The alkyl group having a carbon number of at least 1 and no greater than 6 may have a substituent. Examples of such a substituent include a halogen atom, an alkoxy group having a carbon number of at least 1 and no greater than 6, an aryl group having a carbon number of at least 6 and no greater than 14, a cycloalkyl group having a carbon number of at least 3 and no greater than 10, and a heterocyclic group. The number of substituents is not especially limited but is preferably 3 or less.

The alkoxy group having a carbon number of at least 1 and no greater than 6 represented by $R_1$ or $R_2$ in general formula (I) is preferably an alkoxy group having a carbon number of at least 1 and no greater than 3, and is more preferably a methoxy group. The alkoxy group having a carbon number of at least 1 and no greater than 6 may have a substituent. Examples of such a substituent include a halogen atom, an alkoxy group having a carbon number of at least 1 and no greater than 6, an aryl group having a carbon number of at least 6 and no greater than 14, a cycloalkyl group having a carbon number of at least 3 and no greater than 10, and a heterocyclic group. The number of substituents is not especially limited but is preferably 3 or less.

The aryl group having a carbon number of at least 6 and no greater than 14 represented by $R_1$ or $R_2$ in general formula (I) may have a substituent. Examples of such a substituent include a halogen atom, an alkyl group having a carbon number of at least 1 and no greater than 6, an alkoxy group having a carbon number of at least 1 and no greater than 6, an aryl group having a carbon number of at least 6 and no greater than 14, a cycloalkyl group having a carbon number of at least 3 and no greater than 10, and a heterocyclic group. The number of substituents is not especially limited but is preferably 3 or less.

In general formula (I), an electron resonance effect is exhibited on an aromatic ring (a benzene ring), and therefore, $R_1$ or $R_2$ in general formula (I) preferably each independently represent an alkyl group having a carbon number of at least 1 and no greater than 3, or a methoxy group.

The bonding position of the substituent represented by $R_1$ or $R_2$ is not especially limited. For example, the substituent represented by $R_2$ can be substituted for a butadienyl group bonded to a benzene ring of a phenylbutadienyl group in any of the ortho-position (o-position), the meta-position (m-position), and the para-position (p-position) of the benzene ring. In accordance with the bonding position of $R_2$, the symmetrical structure of the triarylamine derivative (I) can be broken. Besides, the substituent represented by $R_1$ can be substituted for a nitrogen atom bonded to a benzene ring in any of the ortho-position and the meta-position of the benzene ring, and is preferably substituted in the meta-position of the benzene ring. In accordance with the bonding position of $R_1$, the symmetrical structure of the triarylamine derivative (I) can be broken.

In general formula (I), m and n each independently represent an integer of 0 or more and 4 or less. Since the stability in the molecular structure can be attained in general formula (I), m and n preferably each independently represent 0 or 1. If the sum of three ms is an integer of 2 or more, a plurality of $R_1$s present on different aromatic rings may be the same as or different from one another. If m represents an integer of 2 or more, a plurality of $R_1$s present on the same aromatic ring may be the same as or different from one another. If the sum of three ns is an integer of 2 or more, a plurality of $R_2$s present on different aromatic rings may be the same as or different from one another. If n represents an integer of 2 or more, a plurality of $R_2$s present on the same aromatic ring may be the same as or different from one another.

As the hole transport material, the triarylamine derivative (I) may be singly used, or a combination of the triarylamine derivative (I) with another hole transport material may be used. Another hole transport material can be appropriately selected from known hole transport materials. Besides, one type of the triarylamine derivative (I) may be singly used, or two or more types may be used in combination.

The content of the hole transport material is preferably 10 parts by mass or more and 200 parts by mass or less, and more preferably 10 parts by mass or more and 100 parts by mass or less based on 100 parts by mass of the binder resin in the photosensitive layer.

Specific examples of the triarylamine derivative (I) are represented by chemical formulas (HT-1) to (HT-7). Hereinafter, these derivatives are sometimes referred to respectively as triarylamine derivatives (HT-1) to (HT-7).

(HT-1)

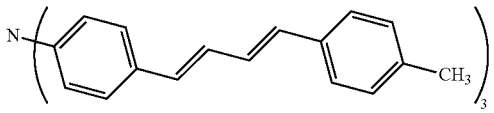

(HT-2)

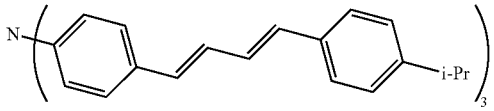

(HT-3)

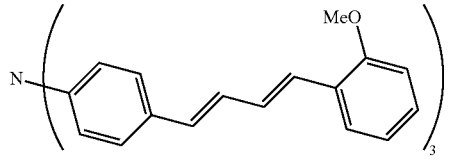

(HT-4)

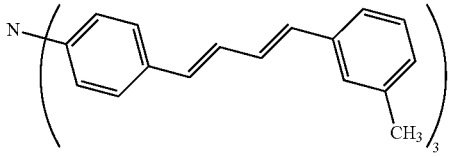

(HT-5)

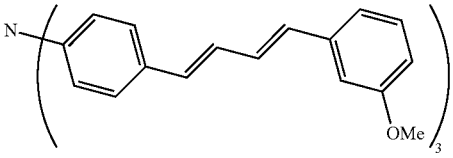

-continued (HT-6)

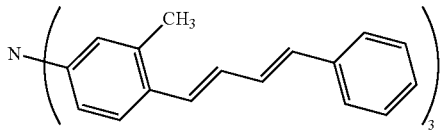

(HT-7)

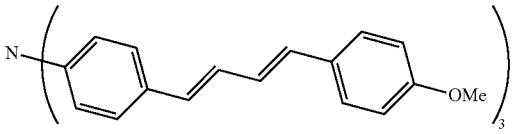

The $^1$H-NMR (proton nuclear magnetic resonance) charts (using $CDCl_3$ as a solvent and TMS as a standard substance) of the triarylamine derivatives (HT-1) to (HT-5) are respectively illustrated in FIGS. 2 to 6. In FIGS. 2 to 6, the ordinate indicates signal intensity, and the abscissa indicates a chemical shift value (ppm).

The triarylamine derivative (I) can be prepared, for example, by a preparation method including reactions represented by the following reaction formulas (R-1), (R-2) and (R-3) (hereinafter, sometimes referred to respectively as the reaction (R-1), the reaction (R-2), and the reaction (R-3)).

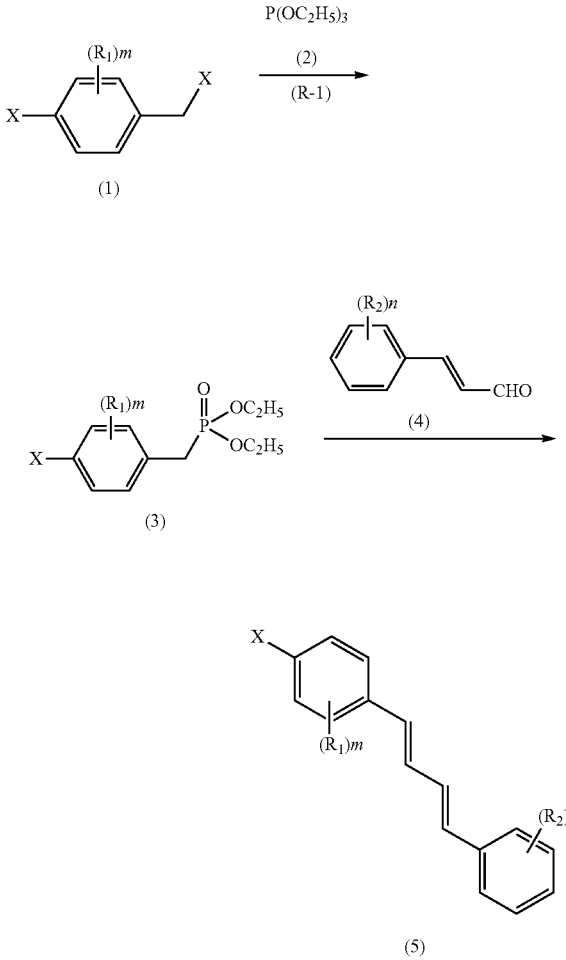

-continued

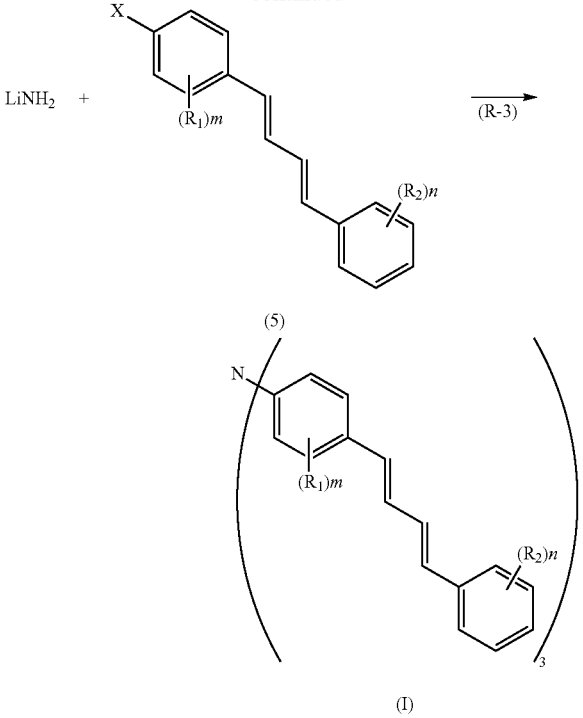

In the reaction formulas (R-1), (R-2) and (R-3), $R_1$, $R_2$, m and n respectively have the same meanings as $R_1$, $R_2$, m and n of general formula (I). Besides, X in the reaction formulas (R-1), (R-2), and (R-3) represents a halogen atom.

The reaction (R-1) will now be described. In the reaction (R-1), a reaction is caused between a compound represented by general formula (1) (hereinafter sometimes referred to as the benzene derivative (1)) and a compound represented by a chemical formula (2) (hereinafter sometimes referred to as the triethyl phosphite (2)) to obtain a compound represented by general formula (3) (hereinafter sometimes referred to as the phosphonate derivative (3)). The reaction (R-1) can be performed in a solvent in the presence of a catalyst or a base. Besides, the obtained phosphonate derivative (3) can be taken out by purifying an extract.

The reaction rate between the benzene derivative (1) and the triethyl phosphite (2) is preferably 1:1 to 1:4 in terms of an amount-of-substance ratio (a molar ratio). If the amount of substance of the triethyl phosphite (2) per mole of the benzene derivative (1) is 1 mole or more, the yield of the phosphonate derivative (3) is difficult to lower. On the other hand, if the amount of substance of the triethyl phosphite (2) per mole of the benzene derivative (1) is 4 moles or less, the triethyl phosphite (2) is difficult to remain unreacted, and the phosphonate derivative (3) is prevented from becoming difficult to purify.

With respect to the reaction (R-1), in order that the desired reaction can be efficiently performed with comparatively simple equipment, the reaction temperature is preferably 160° C. or more and 200° C. or less. For a similar reason, the reaction time is preferably 2 hours or more and 10 hours or less.

Next, the reaction (R-2) will be described. In the reaction (R-2), a reaction (hereinafter sometimes referred to as the Witting reaction) is caused between the phosphonate derivative (3) and a compound represented by general formula (4) (hereinafter sometimes referred to as the cinnamaldehyde derivative (4)) to obtain a compound represented by general formula (5) (hereinafter sometimes referred to as the diphenylbutadiene derivative (5)). The diphenylbutadiene derivative (5) can be taken out by purifying an extract.

The reaction rate between the phosphonate derivative (3) and the cinnamaldehyde derivative (4) is preferably 1:1 to 1:2.5 in terms of a molar ratio. If the amount of substance of the cinnamaldehyde derivative (4) per mole of the phosphonate derivative (3) is 1 mole or more, the yield of the diphenylbutadiene derivative (5) is difficult to lower. On the other hand, if the amount of substance of the cinnamaldehyde derivative (4) per mole of the phosphonate derivative (3) is 2.5 moles or less, the cinnamaldehyde derivative (4) is difficult to remain unreacted, and the diphenylbutadiene derivative (5) is prevented from becoming difficult to purify.

With respect to the Witting reaction, the reaction temperature is preferably 0° C. or more 50° C. or less, and the reaction time is preferably 2 hours or more and 24 hours or less.

The Witting reaction can be performed, for example, in the presence of a catalyst. Examples of the catalyst include a sodium alkoxide (such as a sodium methoxide, or a sodium ethoxide), a metal hydride (such as a sodium hydride, or a potassium hydride), and a metal salt (such as n-butyllithium). One of these catalysts may be singly used, or two or more of these may be used in combination.

The adding amount of the catalyst is preferably 1 mole or more and 2 moles or less per mole of the cinnamaldehyde derivative (4). If the amount of substance of the catalyst per mole of the cinnamaldehyde derivative (4) is 1 mole or more, the reactivity is difficult to lower. If the amount of substance of the catalyst per mole of the cinnamaldehyde derivative (4) is 2 moles or less, the reaction is prevented from becoming difficult to control.

The Witting reaction can be performed, for example, in a solvent. Examples of the solvent include ethers (such as tetrahydrofuran, diethyl ether, and dioxane), halogenated hydrocarbons (such as methylene chloride, chloroform, and dichloroethane), and aromatic hydrocarbons (such as benzene, and toluene).

Next, the reaction (R-3) will be described. In the reaction (R-3), a reaction (a coupling reaction) is caused between the diphenylbutadiene derivative (5) and lithium amide to obtain the triarylamine derivative (I). The triarylamine derivative (I) can be taken out by purifying an extract.

The reaction rate between the diphenylbutadiene derivative (5) and the lithium amide is preferably 5:1 to 3:1 in terms of a molar ratio. If the amount of substance of the diphenylbutadiene derivative (5) per mole of the lithium amide is 3 moles or more, the yield of the triarylamine derivative (I) is difficult to be lowered. If the amount of substance of the diphenylbutadiene derivative (5) per mole of the lithium amide is 5 moles or less, the lithium amide is difficult to remain unreacted, and the triarylamine derivative (I) is prevented from becoming difficult to purify.

With respect to the reaction (R-3), the reaction temperature is preferably 80° C. or more and 140° C. or less, and the reaction time is preferably 2 hours or more and 10 hours or less.

Besides, a palladium compound is preferably used as a catalyst in the reaction (R-3). If the palladium compound is used as a catalyst, the activation energy can be effectively lowered in the reaction (R-3). As a result, the yield of the triarylamine derivative (I) can be further increased.

Examples of the palladium compound include tetravalent palladium compounds (such as a sodium hexachloropalladate (IV) tetrahydrate, and a potassium hexachloropalladate (IV) tetrahydrate), bivalent palladium compounds (such as palladium (II) chloride, palladium (II) bromide, palladium (II) acetate, palladium acetyl acetate (II), dichlorobis(benzonitrile)palladium (II), dichlorobis(triphenyl amine phosphine)palladium (II), dichlorotetramine palladium (II), and dichloro(cycloocta-1,5-dien)palladium (II)), and other palladium compounds (such as tris(dibenzylideneacetone)dipalladium (0), a tris(dibenzylideneacetone)dipalladium chloroform complex (0), and tetrakis(triphenylaminephosphine)palladium (0)). One of these palladium compounds may be singly used, or two or more of these may be used in combination.

The adding amount of the palladium compound is preferably 0.0005 mole or more and 20 moles or less, and more preferably 0.001 mole or more and 1 mole or less per mole of the diphenylbutadiene derivative (5).

The palladium compound may have a structure including a ligand. Thus, the reactivity of the reaction (R-3) can be improved. Examples of the ligand include tricyclohexylphosphine, triphenylphosphine, methyldiphenylphosphine, trifurylphosphine, tri(o-tolyl)phosphine, dicyclohexylphenylphoshine, tri(t-butyl)phosphine, 2,2'-bis(diphenylphosphino)-1,1'-binaphthyl, and 2,2'-bis[(diphenylphosphino)diphenyl]ether. One of these ligands may be singly used, or two or more of these may be used in combination. The adding amount of the ligand is preferably 0.0005 mole or more and 20 moles or less, and more preferably 0.001 mole or more and 1 mole or less per mole of the diphenylbutadiene derivative (5).

The reaction (R-3) is preferably performed in the presence of a base. Thus, halogenated hydrogen generated in the reaction system is rapidly neutralized, so as to improve the catalyst activity. As a result, the yield of the triarylamine derivative (I) can be improved.

The base may be an inorganic base or an organic base. As the organic base, for example, alkali metal alkoxides (such as sodium methoxide, sodium ethoxide, potassium methoxide, potassium ethoxide, lithium tert-butoxide, sodium tert-butoxide, and potassium tert-butoxide) are preferred, and sodium tert-butoxide is more preferred. Besides, examples of the inorganic base include tripotassium phosphate and cesium fluoride.

If the palladium compound is added in an amount of 0.0005 mole or more and 20 moles or less per mole of the diphenylbutadiene derivative (5), the adding amount of the base is preferably 1 mole or more and 10 moles or less, and more preferably 1 mole or more and 5 moles or less.

The reaction (R-3) can be performed in a solvent. Examples of the solvent include xylene (such as o-xylene), toluene, tetrahydrofuran, and dimethylformamide, and xylene is more preferably used.

The preparation method of the triarylamine derivative (I) may include, in addition to the steps of performing any of the reactions (R-1) to (R-3), an appropriate step if necessary.

[2-3. Electron Transport Material]

As described above, the photosensitive layer contains the electron transport material. If the photosensitive layer contains the electron transport material, electrons are easily transported, and hence the occurrence of the transfer memory is inhibited.

Examples of the electron transport material include quinone-based compounds, hydrazone-based compounds, malononitrile-based compounds, thiopyran-based compounds, trinitro thioxanthone-based compounds, 3,4,5,7-tetranitro-9-fluorenone-based compounds, dinitroanthracene-based compounds, dinitroacrydine-based compounds, tetracyanoethylene, 2,4,8-trinitrothioxanthone, dinitrobenzene, dinitroanthracene, dinitroacrydine, succinic anhydride, maleic anhydride, and dibromo maleic anhydride. Examples of the quinone-based compounds include naphthoquinone-based compounds, diphenoquinone-based compounds, anthraquinone-based compounds, azoquinone-based compounds, nitroanthraquinone-based compounds, and dinitroanthraquinone-based compounds. One of these electron transport materials may be singly used, or two or more of these may be used in combination.

Specific examples of the quinone-based compounds include compounds represented by the following general formulas (ETM-I) to (ETM-III):

(ETM-I)

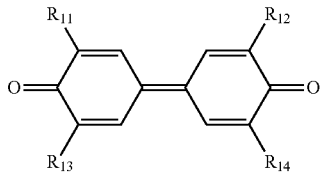

(ETM-II)

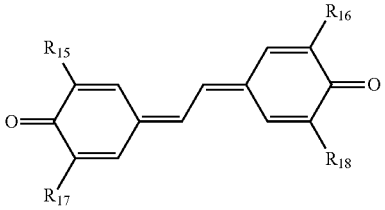

(ETM-III)

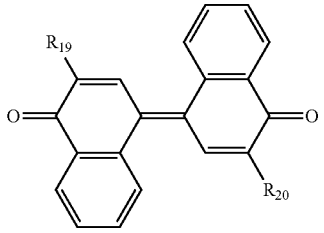

A specific example of the hydrazone-based compounds includes a compound represented by the following general formula (ETM-IV):

(ETM-IV)

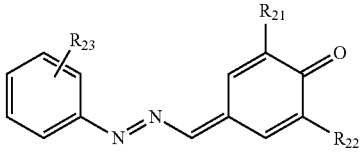

In general formulas (ETM-I) to (ETM-IV), $R_{11}$ to $R_{22}$ each independently represent a hydrogen atom, an optionally substituted alkyl group having a carbon number of at least 1 and no greater than 10, an optionally substituted alkenyl group having a carbon number of at least 2 and no greater than 10, an optionally substituted alkoxy group having a carbon number of at least 1 and no greater than 10, an optionally substituted aralkyl group having a carbon number of at least 7 and no greater than 15, an optionally substituted aryl group having a carbon number of at least 6 and no greater than 14, or an optionally substituted heterocyclic group; and $R_{23}$ represents a halogen atom, a hydrogen atom, an optionally substituted alkyl group having a carbon number of at least 1 and no greater than 10, an optionally substituted alkenyl group having a carbon number of at least 2 and no greater than 10, an optionally substituted alkoxy group having a carbon number of at least 1 and no greater than 10, an optionally substituted aralkyl group having a carbon number of at least 7 and no greater than 15, an optionally substituted aryl group having a carbon number of at least 6 and no greater than 14, or an optionally substituted heterocyclic group.

The alkyl group having a carbon number of at least 1 and no greater than 10 represented by any of $R_{11}$ to $R_{23}$ in general formulas (ETM-I) to (ETM-IV) is preferably an alkyl group having a carbon number of at least 1 and no greater than 6, more preferably an alkyl group having a carbon number of at least 1 and no greater than 5, and particularly preferably a methyl group, a tert-butyl group or a tert-pentyl group. The alkyl group may be a straight chain alkyl group, a branched chain alkyl group, a ring alkyl group, or an alkyl group formed by combining any of these groups. The alkyl group having a carbon number of at least 1 and no greater than 10 may have a substituent. Examples of such a substituent include a halogen atom, a hydroxyl group, an alkoxy group having a carbon number of at least 1 and no greater than 4, and a cyano group. The number of substituents is not especially limited, and is preferably 3 or less.

The alkenyl group having a carbon number of at least 2 and no greater than 10 represented by any of $R_{11}$ to $R_{23}$ in general formulas (ETM-I) to (ETM-IV) is preferably an alkenyl group having a carbon number of at least 2 and no greater than 6, and more preferably an alkenyl group having a carbon number of at least 2 and no greater than 4. The alkenyl group having a carbon number of at least 2 and no greater than 10 may have a substituent. Examples of such a substituent include a halogen atom, a hydroxyl group, an alkoxy group having a carbon number of at least 1 and no greater than 4, and a cyano group. The number of substituents is not especially limited, and is preferably 3 or less.

The alkoxy group having a carbon number of at least 1 and no greater than 10 represented by any of $R_{11}$ to $R_{23}$ in general formulas (ETM-I) to (ETM-IV) is preferably an alkoxy group having a carbon number of at least 1 and no greater than 6, and more preferably an alkoxy group having a carbon number of at least 1 and no greater than 4. The alkoxy group having a carbon number of at least 1 and no greater than 10 may have a substituent. Examples of such a substituent include a halogen atom, a hydroxyl group, an alkoxy group having a carbon number of at least 1 and no greater than 4, and a cyano group. The number of substituents is not especially limited, and is preferably 3 or less.

The aralkyl group having a carbon number of at least 7 and no greater than 15 represented by any of $R_{11}$ to $R_{23}$ in general formulas (ETM-I) to (ETM-IV) is preferably an aralkyl group having a carbon number of at least 7 and no greater than 12. The aralkyl group having a carbon number of at least 7 and no greater than 15 may have a substituent. Examples of such a substituent include a halogen atom, a hydroxyl group, an alkyl group having a carbon number of at least 1 and no greater than 4, an alkoxy group having a carbon number of at least 1 and no greater than 4, a nitro group, a cyano group, an aliphatic acyl group having a carbon number of at least 2 and no greater than 4, a benzoyl group, a phenoxy group, an alkoxycarbonyl group having a carbon number of at least 2 and no greater than 5, and a phenoxycarbonyl group. The number of substituents is not especially limited, and is preferably 5 or less, and more preferably 3 or less.

The aryl group having a carbon number of at least 6 and no greater than 14 represented by any of $R_{11}$ to $R_{23}$ in general formulas (ETM-I) to (ETM-IV) may have a substituent. Examples of such a substituent include a halogen atom, a hydroxyl group, an alkyl group having a carbon number of at least 1 and no greater than 4, an alkoxy group having a carbon number of at least 1 and no greater than 4, a nitro group, a cyano group, an aliphatic acyl group having a carbon number of at least 2 and no greater than 4, a benzoyl group, a phenoxy group, an alkoxycarbonyl group having a carbon number of at least 2 and no greater than 5, and a phenoxycarbonyl group.

The heterocyclic group represented by any of $R_{11}$ to $R_{23}$ in general formulas (ETM-I) to (ETM-IV) may have a substituent. Examples of such a substituent include a halogen atom, a hydroxyl group, an alkyl group having a carbon number of at least 1 and no greater than 4, an alkoxy group having a carbon number of at least 1 and no greater than 4, a nitro group, a cyano group, an aliphatic acyl group having a carbon number of at least 2 and no greater than 4, a benzoyl group, a phenoxy group, an alkoxycarbonyl group having a carbon number of at least 2 and no greater than 5, and a phenoxycarbonyl group.

The halogen atom represented by $R_{23}$ in general formula (ETM-IV) is preferably a chlorine atom.

Specific examples of the compounds represented by general formulas (ETM-I) to (ETM-IV) include compounds respectively represented by chemical formulas (ETM-1) to (ETM-4).

(ETM-1)

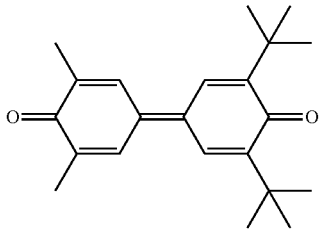

(ETM-2)

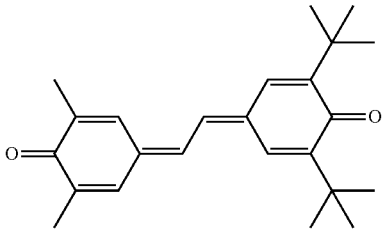

(ETM-3)

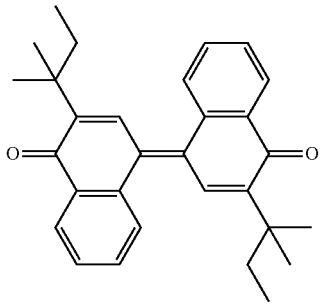

-continued (ETM-4)

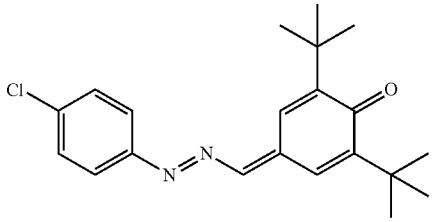

The content of the electron transport material is preferably 5 parts by mass or more and 100 parts by mass or less, and more preferably 10 parts by mass or more and 80 parts by mass or less based on 100 parts by mass of the binder resin in the photosensitive layer of the photosensitive member.

[2-4. Binder Resin]

Examples of the binder resin include thermoplastic resins, thermosetting resins, and photocurable resins. Examples of the thermoplastic resins include polycarbonate resins, styrene-based resins, styrene-butadiene copolymers, styrene-acrylonitrile copolymers, styrene-maleic acid copolymers, styrene-acrylic acid copolymers, acrylic copolymers, polyethylene resins, ethylene-vinyl acetate copolymers, chlorinated polyethylene resins, polyvinyl chloride resins, polypropylene resins, ionomers, vinyl chloride-vinyl acetate copolymers, alkyd resins, polyamide resins, urethane resins, polyarylate resins, polysulfone resins, diallyl phthalate resins, ketone resins, polyvinyl butyral resins, polyether resins, and polyester resins. Examples of the thermosetting resins include silicone resins, epoxy resins, phenolic resins, urea resins, melamine resins, and other crosslinkable thermosetting resins. Examples of the photocurable resins include epoxy acrylate resins and urethane-acrylate copolymers. One of these binder resins may be singly used, or two or more of these may be used in combination.

Among these resins, the binder resin is preferably a polycarbonate resin for obtaining a photosensitive layer having excellent balance in terms of processability, mechanical properties, optical properties, and/or abrasion resistance. Examples of the polycarbonate resin include bisphenol Z polycarbonate resin, bisphenol B polycarbonate resin, bisphenol CZ polycarbonate resin, bisphenol C polycarbonate resin, and bisphenol A polycarbonate resin. A more specific example of the polycarbonate resin includes a resin having a repeating unit represented by chemical formula (Resin-1).

(Resin-I)

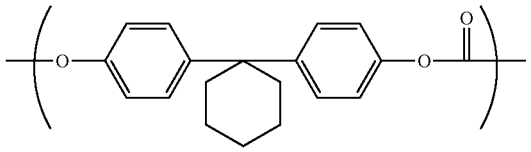

The viscosity average molecular weight of the binder resin is preferably 40,000 or more, and more preferably 40,000 or more and 52,500 or less. If the binder resin has a viscosity average molecular weight of 40,000 or more, the abrasion resistance of the binder resin may be sufficiently improved, and hence, the photosensitive layer is difficult to abrade. If the molecular weight of the binder resin is 52,500 or less, the binder resin is easily dissolved in a solvent in forming the photosensitive layer, and hence, an application liquid for a photosensitive layer (hereinafter sometimes referred to simply as the application liquid) is prevented from having too high viscosity. As a result, the photosensitive layer can be easily formed.

[2-5. Additives]

In the photosensitive member of the first embodiment, various additives may be contained in the photosensitive layer unless the electrophotographic characteristics are harmfully affected. Examples of the additives include antidegradants (such as antioxidants, radical scavengers, singlet quenchers, and ultraviolet absorbing agents), softeners, surface modifiers, extenders, thickeners, dispersion stabilizers, waxes, acceptors, donors, surfactants, plasticizers, sensitizers, and leveling agents. Examples of the antioxidants include hindered phenols, hindered amines, paraphenylenediamine, arylalkanes, hydroquinone, spirochromanes, spiroindanones, derivatives of any of the above compounds, organosulfur compounds, and organophosphorus compounds.

[3. Intermediate Layer]

In the photosensitive member, the intermediate layer (in particular, an undercoat layer) may be located between the conductive substrate and the photosensitive layer. The intermediate layer contains, for example, an inorganic particle and a resin to be used in the intermediate layer (intermediate layer resin). Provision of the intermediate layer may facilitate flow of current generated when the photosensitive member is exposed to light and inhibit increasing resistance, while also maintaining insulation to a sufficient degree so as to inhibit leakage current from occurring.

Examples of the inorganic particle include particles of metals (such as aluminum, iron, and copper), particles of metal oxides (such as titanium oxide, alumina, zirconium oxide, tin oxide, and zinc oxide), and particles of metal-free oxides (such as silica). Any of these inorganic particles may be singly used or a combination of any two or more of these inorganic particles may be used.

The intermediate layer resin is not especially limited as long as it can be used as a resin for forming the intermediate layer.

The intermediate layer may contain various additives unless the electrophotographic characteristics are harmfully affected. Additives described above as those for the photosensitive layer may be similarly used.

[4. Manufacturing Method of Photosensitive Member]

Next, referring to FIG. 1, a manufacturing method of the photosensitive member 1 of the first embodiment will be described. The manufacturing method of the photosensitive member 1 of the first embodiment can include a photosensitive layer forming step. In the photosensitive layer forming step, the photosensitive layer 3 is formed by applying the application liquid onto the conductive substrate 2, and removing the solvent contained in the applied application liquid. The application liquid can contain at least the charge generating material, the triarylamine derivative (I), the electron transport material, the binder resin, and the solvent. The application liquid can be prepared by dissolving or dispersing, in the solvent, the charge generating material, the triarylamine derivative (I), the electron transport material, and the binder resin. The application liquid may contain various additives if necessary.

The solvent contained in the application liquid is not especially limited as long as the respective components of the application liquid can be dissolved or dispersed therein. Examples of the solvent include alcohols (such as methanol, ethanol, isopropanol, and butanol), aliphatic hydrocarbons (such as n-hexane, octane, and cyclohexane), aromatic hydrocarbons (such as benzene, toluene, and xylene), halogenated hydrocarbons (such as dichloromethane, dichloroethane, carbon tetrachloride, and chlorobenzene), ethers (such as dimethyl ether, diethyl ether, tetrahydrofuran, ethylene glycol dimethyl ether, and diethylene glycol dimethyl ether), ketones (such as acetone, methyl ethyl ketone, and cyclohexanone), esters (such as ethyl acetate, and methyl acetate), dimethyl formaldehyde, N,N-dimethylformamide (DMF), and dimethyl sulfoxide. One of these solvents may be singly used, or two or more of these may be used in combination. Among these solvents, a non-halogenated solvent is preferably used as the solvent contained in the application liquid.

The application liquid is prepared by mixing the respective components to be dispersed in the solvent. The components can be mixed or dispersed by using, for example, a bead mill, a roll mill, a ball mill, an attritor, a paint shaker, or an ultrasonic disperser.

The application liquid may contain, for example, a surfactant or a leveling agent in order to improve the dispersibility of the components, or the surface smoothness of each layer to be formed therefrom.

The method for applying the application liquid is not especially limited as long as the application liquid can be uniformly applied onto the conductive substrate 2. Examples of the application method include dip coating, spray coating, spin coating, and bar coating.

The method for removing the solvent contained in the application liquid is not especially limited as long as the solvent contained in the application liquid can be evaporated. Examples of the solvent removing method include heating, depressurization, and a combination of heating and depressurization. More specifically, a heat treatment (hot-air drying) using a high-temperature dryer or a reduced pressure dryer can be employed. The heat treatment is performed under conditions of a heating temperature of, for example, preferably 40° C. or more and 150° C. or less, and a heating time of, for example, preferably 3 minutes or more and 120 minutes or less.

The manufacturing method of the photosensitive member 1 may further include a step of forming the intermediate layer 4 and/or a step of forming the protective layer 5 if necessary. Any of known methods can be appropriately employed in the step of forming the intermediate layer 4 and the step of forming the protective layer 5.

The photosensitive member 1 of the first embodiment is used as an image bearing member in an image forming apparatus including a charging section configured to be in contact with the image bearing member to apply a voltage thereto. The photosensitive member 1 of the first embodiment can inhibit the occurrence of the transfer memory also in the image forming apparatus including the charging section configured to be in contact with the image bearing member to apply a voltage thereto.

The photosensitive member 1 of the first embodiment has been described so far with reference to FIGS. 1A to 1C. The photosensitive member 1 of the first embodiment can inhibit the occurrence of the transfer memory.

Second Embodiment: Image Forming Apparatus

Figure 7:
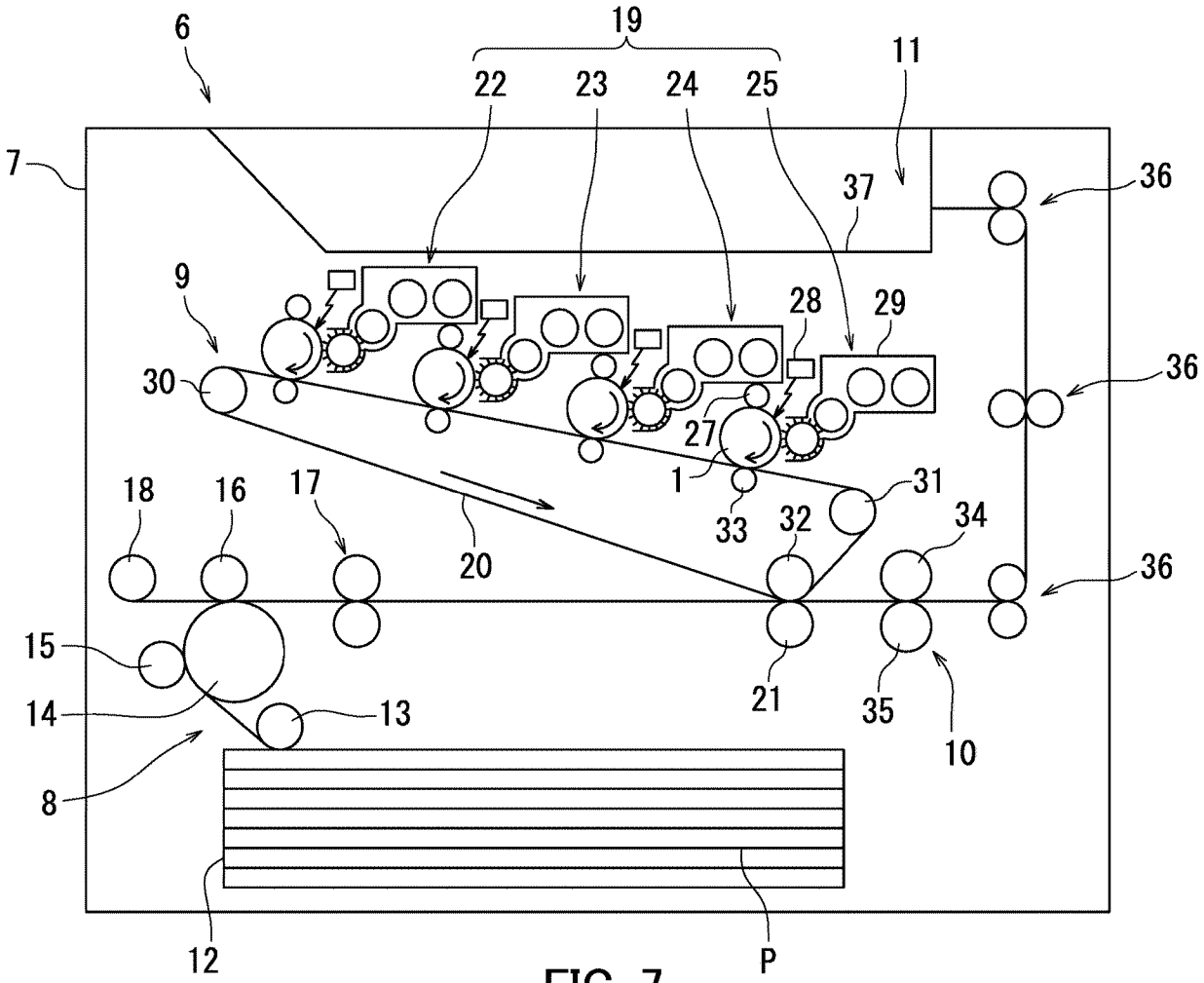
FIG. 7 is a schematic diagram illustrating the structure of one aspect of an image forming apparatus according to a second embodiment.

A second embodiment relates to an image forming apparatus. One aspect of the image forming apparatus of the second embodiment will now be described with reference to FIG. 7. FIG. 7 is a schematic diagram illustrating the structure according to one aspect of the image forming apparatus of the second embodiment. The image forming apparatus 6 includes the photosensitive member 1 of the first embodiment. The photosensitive member 1 is used as an image bearing member.

The image forming apparatus 6 of the second embodiment includes the image bearing member 1 corresponding to the photosensitive member, a charging section 27 corresponding to a charger, a light exposure section 28 corresponding to a light exposure device, a developing section 29 corresponding to a developing device, and a transfer section. The charging section 27 positively charges a surface of the image bearing member 1. The charging section 27 has a positive charging polarity. The charging section 27 is configured to be in contact with the image bearing member 1 to apply a voltage thereto. The light exposure section 28 exposes the charged surface of the image bearing member 1 to light to form an electrostatic latent image on the surface of the image bearing member 1. The developing section 29 develops the electrostatic latent image into a toner image. In the transfer section, the toner image is transferred onto a transfer target (an intermediate transfer belt 20) from the image bearing member 1 with the image bearing member 1 and the intermediate transfer belt 20 kept in contact with each other. If the image forming apparatus 6 adopts the intermediate transfer process, the transfer section corresponds to a primary transfer roller 33 and a secondary transfer roller 21. The image bearing member is the photosensitive member 1 of the first embodiment.

The image forming apparatus 6 of the second embodiment includes the photosensitive member 1 of the first embodiment as the image bearing member. Therefore, in the image forming apparatus 6 of the second embodiment, occurrence of an image defect (such as an image ghost) derived from the transfer memory can be inhibited. The reason is presumed as follows:

For convenience, an image defect derived from the transfer memory will be first described. When the transfer memory occurs as described above, a region, on the surface of the image bearing member 1, where a desired potential cannot be attained in the charging step of the next rotation tends to have a lower potential than a region where the desired potential can be attained in the charging step of the next rotation. Specifically, an unexposed region on the surface of the image bearing member 1 not exposed during the previous rotation tends to have a lower potential than an exposed region exposed during the previous rotation. Therefore, the unexposed region of the previous rotation easily attracts a positively charged toner because its potential is easily lowered as compared with the exposed region of the previous rotation. As a result, an image affected by a non-image-formed portion (the unexposed region) of the previous rotation tends to be formed. An image defect in which such an image affected by a non-image-formed portion of the previous rotation is formed refers to an image defect derived from the transfer memory.

As described above, the photosensitive member 1 of the first embodiment tends to inhibit the occurrence of the transfer memory. Therefore, since the image forming apparatus 6 of the second embodiment includes the photosensitive member 1 of the first embodiment as the image bearing member, it is presumed that an image defect derived from the transfer memory can be inhibited.

The image forming apparatus 6 is not especially limited as long as it is an electrophotographic image forming apparatus. The image forming apparatus 6 may be, for example, a monochrome image forming apparatus or a color image forming apparatus. The image forming apparatus 6 may be a tandem color image forming apparatus for forming toner images of different colors by using different color toners.

The image forming apparatus 6 will now be described on the assumption of a tandem color image forming apparatus. The image forming apparatus 6 includes a plurality of the photosensitive members 1 arranged in a prescribed direction and a plurality of the developing sections 29. The developing sections 29 are arranged in one-to-one correspondence with the photosensitive members 1. Each of the developing sections 29 includes a development roller. The development roller bears a toner thereon, and conveys and supplies the toner to the surface of a corresponding one of the image bearing members 1.

As illustrated in FIG. 7, the image forming apparatus 6 further includes a box shaped apparatus housing 7. The apparatus housing 7 houses a paper feed section 8, an image forming section 9, and a fixing section 10. The paper feed section 8 feeds paper P. The image forming section 9 transfers a toner image based on image data onto the paper P fed from the paper feed section 8 while conveying the paper P. The fixing section 10 fixes, to the paper P, the unfixed toner image that has been transferred onto the paper P by the image forming section 9. A paper ejection section 11 is provided on a top surface of the apparatus housing 7. The paper ejection section 11 ejects the paper P after the paper P has been subjected to a fixing process by the fixing section 10.

The paper feed section 8 includes a paper feed cassette 12, a first pick-up roller 13, paper feed rollers 14, 15, and 16, and a pair of registration rollers 17. The paper feed cassette 12 is detachable from the apparatus housing 7. Various sizes of paper P can be loaded into the paper feed cassette 12. The first pick-up roller 13 is located above a left-hand side of the paper feed cassette 12. The first pick-up roller 13 picks up paper P one sheet at a time from the paper feed cassette 12 in which the paper P is loaded. The paper feed rollers 14, 15, and 16 convey the paper P that is picked up by the first pick-up roller 13. The pair of registration rollers 17 temporarily halts the paper P that is conveyed by the paper feed rollers 14, 15, and 16, and subsequently feeds the paper P to the image forming section 9 at a specific timing.

The paper feed section 8 further includes a manual feed tray (not illustrated) and a second pick-up roller 18. The manual feed tray is attached to a left side surface of the apparatus housing 7. The second pick-up roller 18 picks up paper P that is loaded on the manual feed tray. The paper P that is picked up by the second pick-up roller 18 is then conveyed by the paper feed rollers 14, 15, and 16, and fed to the image forming section 9 at the specific timing by the pair of registration rollers 17.

The image forming section 9 includes an image forming unit 19, an intermediate transfer belt 20, and a secondary transfer roller 21. The image forming unit 19 performs primary transfer of a toner image onto a surface of the intermediate transfer belt 20 (a surface in contact with the surface of the primary transfer roller 33). The toner image that is subjected to the primary transfer is formed based on image data that is transmitted from a higher-level device such as a computer. The secondary transfer roller 21 performs secondary transfer of the toner image on the intermediate transfer belt 20 to paper P that is fed from the paper feed cassette 12.

In the image forming unit 19, a yellow toner supply unit 25, a magenta toner supply unit 24, a cyan toner supply unit 23, and a black toner supply unit 22 are arranged in stated order from upstream (right-hand side of FIG. 7) to downstream of a rotation direction of the intermediate transfer belt 20. The photosensitive member 1 is provided at a central position in a corresponding one of the toner supply units 22, 23, 24, and 25. The photosensitive member 1 is rotatable in an arrow direction (i.e., clockwise). The toner supply units 22, 23, 24, and 25 may be process cartridges to be described later that are attached to or detached from the body of the image forming apparatus 6.

Around each of the image bearing member 1, the charging section 27, the light exposure section 28, and the developing section 29 are arranged in stated order from upstream to downstream of a rotation direction of the image bearing member 1.

A static eliminator (not illustrated) and a cleaning device (not illustrated) may be provided upstream of the charging section 27 in the rotation direction of the image bearing member 1. After the primary transfer of a toner image onto the intermediate transfer belt 20 is completed, the static eliminator eliminates static electricity from the circumferential surface (surface) of the image bearing member 1. After the surface of the image bearing member 1 has been cleaned by the cleaning device and static electricity has been eliminated from the surface by the static eliminator, the circumferential surface of the image bearing member 1 returns to a position corresponding to the charging section 27 and a new charging process is performed.

The image forming apparatus 6 according to the second embodiment may include cleaning sections corresponding to the cleaning device and/or static eliminating sections corresponding to the static eliminators. In a configuration in which the image forming apparatus 6 according to the second embodiment includes the cleaning sections and the static eliminating sections, each of the cleaning sections and each of the static eliminating sections are arranged as follows. That is, around each of the image bearing members 1, the charging section 27, the light exposure section 28, the developing section 29, the transfer section, the cleaning section, and the static eliminating section are arranged in stated order from upstream to downstream of the rotation direction of the image bearing member 1.

As already mentioned above, the charging section 27 charges the surface of the image bearing member 1. More specifically, the charging section 27 uniformly charges the circumferential surface of the image bearing member 1. The charging section 27 is in contact with the image bearing member to apply a voltage thereto. The charging section 27 is designated also as what is called a contact charging section. Examples of such a contact charging section 27 include a charging roller and a charging brush, and a charging roller is preferably used. If the contact charging section 27 is employed, emission of active gases (for example, ozone and nitrogen oxides) produced by the charging section 27 can be suppressed. As a result, degradation of the photosensitive layer 3 otherwise caused by the active gases can be inhibited while realizing apparatus design in consideration of an office environment.

If the charging section 27 includes a contact charging roller, the charging roller charges the circumferential surface of the image bearing member 1 while in contact with the image bearing member 1. An example of such a charging roller includes a charging roller rotationally driven by rotation of the image bearing member 1 while in contact with the image bearing member 1. Another example of the charging roller includes a charging roller having at least a surface portion made of a resin. More specifically, the charging roller includes a metal core that is axially supported in a rotatable manner, a resin layer formed on the metal core, and a voltage application section that applies a voltage to the metal core. If the charging section 27 includes such a charging roller, the surface of the photosensitive member 1 can be charged via the resin layer in contact with the photosensitive member 1 by applying a voltage to the metal core by the voltage application section.

The resin used for forming the resin layer of the charging roller is not especially limited as long as the circumferential surface of the image bearing member 1 can be satisfactorily charged. Specific examples of the resin used for forming the resin layer include silicone resins, urethane resins, and silicone modified resins. The resin layer may optionally contain an inorganic filler.

The voltage applied by the charging section 27 is not especially limited, and examples of the voltage applied by the charging section 27 include a direct current voltage, an alternating current voltage and a superimposed voltage of an alternating current voltage superimposed on a direct current voltage. The charging section 27 applying merely a direct current voltage is superior, in the following points, to a charging section applying an alternating current voltage or a charging section applying a superimposed voltage of an alternating current voltage superimposed on a direct current voltage. If the charging section 27 applies merely a direct current voltage, the value of a voltage applied to the image bearing member 1 is constant, and hence, the surface of the image bearing member 1 can be easily charged uniformly to a prescribed potential. Besides, if the charging section 27 applies merely a direct current voltage, abrasion of the photosensitive layer 3 tends to be smaller. As a result, suitable images can be formed. The direct current voltage applied by the charging section 27 to the photosensitive member 1 is preferably 1,000 V or more and 2,000 V or less, more preferably 1,200 V or more and 1,800 V or less, and particularly preferably 1,400 V or more and 1,600 V or less.

There is a tendency that the transfer memory is more easily caused under application of a direct current voltage than under application of an alternating current voltage. The image forming apparatus 6 of the second embodiment includes, however, the photosensitive member 1 of the first embodiment as the image bearing member, and therefore, even if the image forming apparatus 6 of the second embodiment includes the charging section configured to be in contact with the image bearing member to apply a direct current voltage thereto, the occurrence of an image defect otherwise caused by the transfer memory can be inhibited.

The light exposure section 28 is, for example, a laser scanning unit. The light exposure section 28 forms an electrostatic latent image on the surface of the image bearing member 1 by exposing the charged surface of the image bearing member 1 to light. More specifically, after the circumferential surface of the image bearing member 1 has been uniformly charged by the charging section 27, the light exposure section 28 irradiates the circumferential surface of the image bearing member 1 with laser light based on image data input from a higher-level device such as a personal computer. Thus, an electrostatic latent image based on the image data is formed on the circumferential surface of the image bearing member 1.

The developing section 29 develops the electrostatic latent image into a toner image. More specifically, the developing section 29 forms a toner image based on the image data by supplying a toner to the circumferential surface of the image bearing member 1 having the electrostatic latent image formed thereon. Next, primary transfer of the formed toner image onto the intermediate transfer belt 20 is performed. It is noted that the toner has a positive charging polarity.

The intermediate transfer belt 20 is a rotating endless belt. The intermediate transfer belt 20 is stretched around a drive roller 30, a driven roller 31, a backup roller 32, and the plural primary transfer rollers 33. The intermediate transfer belt 20 is disposed such that the circumferential surface of each of the image bearing members 1 is in contact with the surface (contact surface) of the intermediate transfer belt 20.

The intermediate transfer belt 20 is pressed against each of the image bearing members 1 by a corresponding one of the primary transfer rollers 33 that is located to oppose the image bearing member 1. The intermediate transfer belt 20 is endlessly rotated by the drive roller 30 in an arrow direction (i.e., counterclockwise) while in the pressed state. The drive roller 30 is rotationally driven by a drive source such as a stepper motor and imparts driving force for the endless rotation of the intermediate transfer belt 20. The driven roller 31, the backup roller 32, and the plural primary transfer rollers 33 are freely rotatable. The driven roller 31, the backup roller 32, and the primary transfer rollers 33 passively rotate in accompaniment to the endless rotation of the intermediate transfer belt 20 caused by the drive roller 30. The driven roller 31, the backup roller 32, and the primary transfer rollers 33 passively rotate via the intermediate transfer belt 20, in response to active rotation of the drive roller 30, while supporting the intermediate transfer belt 20.

The transfer section transfers the toner image from the image bearing member 1 onto the intermediate transfer belt 20. More specifically, each of the primary transfer rollers 33 applies a primary transfer bias (specifically, a bias of opposite polarity to the toner charging polarity) to the intermediate transfer belt 20. As a result, the toner images formed on the image bearing members 1 are transferred (as the primary transfer) onto the intermediate transfer belt 20 in order as the intermediate transfer belt 20 rotates between each of the photosensitive members 1 and the corresponding primary transfer roller 33.

The secondary transfer roller 21 applies a secondary transfer bias (specifically, a bias of opposite polarity to the toner images) to the paper P. As a result, the toner images that have been transferred onto the intermediate transfer belt 20 through the primary transfer are transferred onto the paper P between the secondary transfer roller 21 and the backup roller 32. Thus, an unfixed toner image is transferred onto the paper P.

The fixing section 10 fixes, to the paper P, the unfixed toner image that has been transferred onto the paper P by the image forming section 9. The fixing section 10 includes a heating roller 34 and a pressure roller 35. The heating roller 34 is heated by a conductive heating element. The pressure roller 35 is located to oppose the heating roller 34 and has a circumferential surface that is pressed against a circumferential surface of the heating roller 34.

The transferred image that has been transferred onto the paper P by the secondary transfer roller 21 in the image forming section 9 is subsequently fixed to the paper P through a fixing process in which the paper P is heated as the paper P passes between the heating roller 34 and the pressure roller 35. After the paper P has been subjected to the fixing process, the paper P is ejected to the paper ejection section 11. A plurality of conveyance rollers 36 are provided at appropriate locations between the fixing section 10 and the paper ejection section 11.

The paper ejection section 11 is formed by a recess formed in a top part of the apparatus housing 7. An exit tray 37 for receiving the ejected paper P is provided at the bottom of the recess. The image forming apparatus 6 according to the second embodiment has been described so far with reference to FIG. 7.

Figure 8:
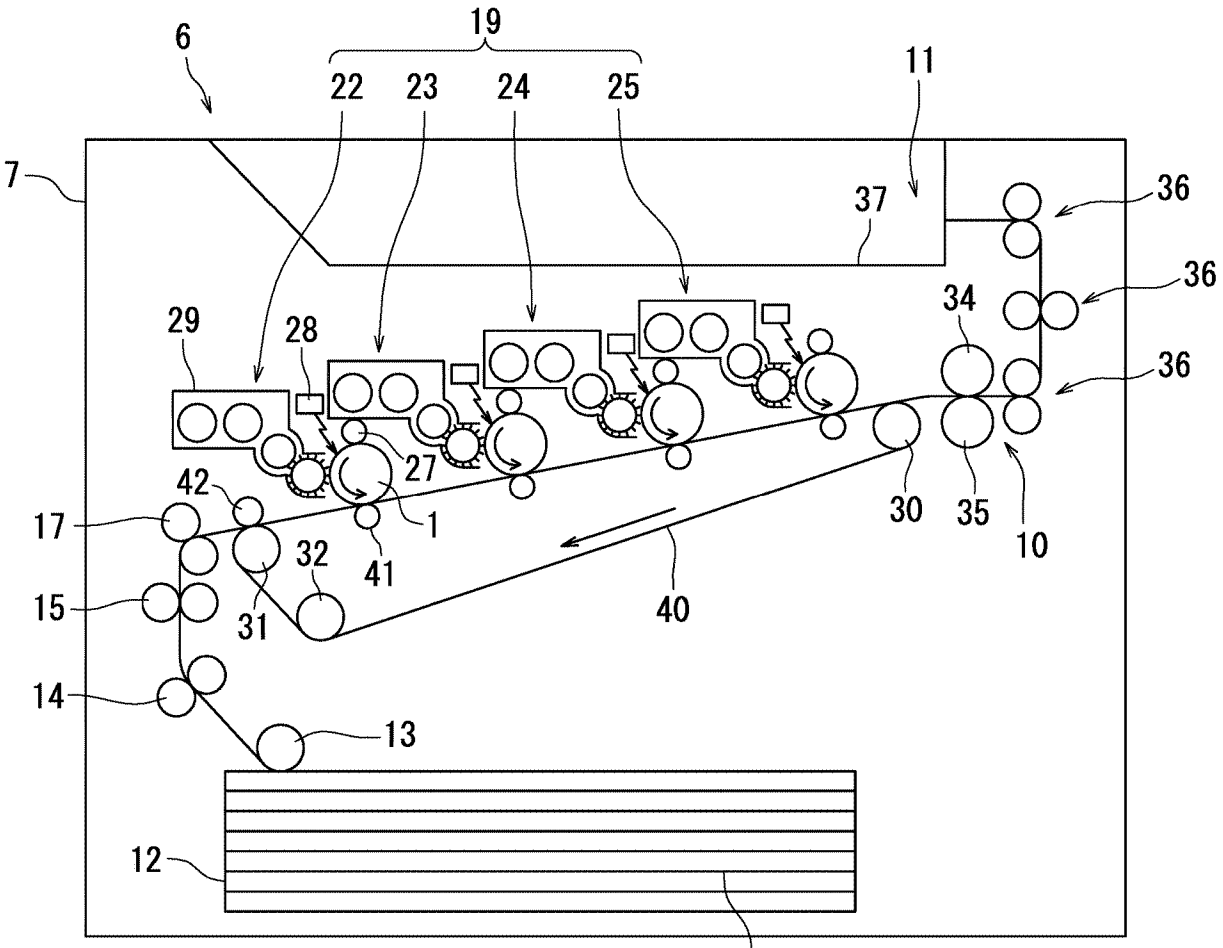
FIG. 8 is a schematic diagram illustrating the structure of another aspect of the image forming apparatus according to the second embodiment.

An image forming apparatus according to another aspect of the second embodiment will now be described with reference to FIG. 8. FIG. 8 is a schematic diagram illustrating the structure of another aspect of the image forming apparatus of the second embodiment. In the image forming apparatus 6 of FIG. 8, a transfer section corresponds to a transfer roller 41. In the image forming apparatus 6 of FIG. 8, a transfer target corresponds to a recording medium (paper P). In other words, the image forming apparatus of FIG. 8 adopts a direct transfer process. It is noted that like reference numerals are used in FIG. 8 to refer to like elements used in FIG. 7 so as to omit redundant description.

In the image forming apparatus 6 adopting the direct transfer process, an image bearing member is easily affected by a transfer bias, and hence, the transfer memory easily occurs in general. The photosensitive member 1 of the first embodiment tends, however, to inhibit the occurrence of the transfer memory as described above. Therefore, since the image forming apparatus 6 of FIG. 8 includes the photosensitive member 1 of the first embodiment as the image bearing member 1, even if the image forming apparatus 6 adopts the direct transfer process, it is presumed that the occurrence of an image defect otherwise caused by the transfer memory can be inhibited.

As illustrated in FIG. 8, a transfer belt 40 is a rotating endless belt. The transfer belt 40 is stretched around a drive roller 30, a driven roller 31, a backup roller 32, and a plurality of transfer rollers 41. The transfer belt 40 is disposed such that the circumferential surface of each of the image bearing members 1 is in contact with the surface (contact surface) of the transfer belt 40. The transfer belt 40 is pressed against each of the image bearing members 1 by a corresponding one of the transfer rollers 41 that is located to oppose the image bearing member 1. The transfer belt 40 is endlessly rotated by the plural rollers 30, 31, 32, and 41 while in the pressed state. The drive roller 30 is rotationally driven by a drive source such as a stepper motor and imparts driving force for the endless rotation of the transfer belt 40. The driven roller 31, the backup roller 32, and the transfer rollers 41 are freely rotatable. The driven roller 31, the backup roller 32, and the plural transfer rollers 41 passively rotate in accompaniment to the endless rotation of the transfer belt 40 caused by the drive roller 30. These rollers 31, 32, and 41 passively rotate while supporting the transfer belt 40. The paper P having been supplied from the pair of registration rollers 17 is adsorbed onto the transfer belt 40 by an adsorption roller 42. The paper P having been adsorbed onto the transfer belt 40 passes between each of the image bearing members 1 and a corresponding one of the transfer rollers 41 in accompaniment to the rotation of the transfer belt 40.

The transfer section transfers the toner image from the image bearing member 1 onto the paper P with the image bearing member 1 kept in contact with the paper P. More specifically, each of the transfer rollers 41 applies a transfer bias (specifically, a bias of opposite polarity to the toner charging polarity) to the paper P adsorbed onto the transfer belt 40. As a result, the toner images formed on the image bearing members 1 are transferred onto the paper P between each of the photosensitive members 1 and the corresponding transfer roller 41. The transfer belt 40 is driven by the drive roller 30 to rotate in an arrow direction (i.e., clockwise). In accompaniment to this rotation, the paper P adsorbed onto the transfer belt 40 passes successively between each of the photosensitive members 1 and the corresponding transfer roller 41. When the paper P passes, toner images in corresponding colors formed on the respective image bearing members 1 are successively transferred to be overlapped on the paper P. Thereafter, each of the image bearing members 1 further rotates to perform the next process. The image forming apparatus adopting the direct transfer process according to another aspect of the second embodiment has been described so far with reference to FIG. 8.

As described above with reference to FIGS. 7 and 8, the image forming apparatus 6 of the second embodiment includes, as the image bearing member, the photosensitive member 1 of the first embodiment capable of inhibiting the occurrence of the transfer memory. The photosensitive member 1 can inhibit the occurrence of the transfer memory. Since the image forming apparatus 6 of the second embodiment includes this photosensitive member, the occurrence of an image defect can be inhibited.

Third Embodiment: Process Cartridge

A third embodiment relates to a process cartridge. The process cartridge according to the third embodiment includes the photosensitive member 1 according to the first embodiment as an image bearing member. The process cartridge according to the third embodiment can inhibit the occurrence of an image defect derived from the transfer memory. The reason is presumed as follows: As described above, the photosensitive member 1 according to the first embodiment tends to inhibit the occurrence of the transfer memory. Accordingly, since the process cartridge of the third embodiment includes the photosensitive member 1 of the first embodiment as the image bearing member, it is presumed that the occurrence of an image defect derived from the transfer memory can be inhibited.

The process cartridge may include, for example, the photosensitive member 1 of the first embodiment having been unitized as an image bearing member. The process cartridge may be designed to be freely attachable to and detachable from the image forming apparatus 6 according to the second embodiment. The process cartridge may adopt, for example, a unitized configuration including, in addition to the image bearing member, at least one section selected from the group consisting of a charging section, a light exposure section, a developing section, a transfer section, a cleaning section, and a static eliminating section. The charging section, the light exposure section, the developing section, the transfer section, the cleaning section, and the static eliminating section may have the same configurations as the charging section 27, the light exposure section 28, the transfer section, the developing section 29, the cleaning section, and the static eliminating section described in the second embodiment, respectively.

The process cartridge of the third embodiment has been described so far. The process cartridge of the third embodiment can inhibit the occurrence of an image defect derived from the transfer memory. Besides, this process cartridge is easy to handle, and hence, if the sensitivity characteristic or the like of the photosensitive member 1 is degraded, the process cartridge including the photosensitive member can be easily and rapidly exchanged.

EXAMPLES

The present disclosure will now be described more specifically with reference to examples. It is noted that the present disclosure is not limited to the scope of these examples.

1. Preparation of Photosensitive Member

Photosensitive members (A-1) to (A-25) and (B-1) to (B-8) were each prepared using a charge generating material, a hole transport material, an electron transport material, and a binder resin.

[1-1. Preparation of Charge Generating Material]

In the preparation of the photosensitive members (A-1) to (A-25) and (B-1) to (B-8), any of the following charge generating materials was used. Specifically, as shown in Tables 1 and 2, X-form metal-free phthalocyanine (hereinafter sometimes referred to as the "charge generating material (X—$H_2$Pc)") or titanyl phthalocyanine (hereinafter sometimes referred to as the "charge generating material (TiOPc)") described above in the first embodiment was used.

[1-2. Preparation of Hole Transport Material]

In the preparation of the photosensitive members (A-1) to (A-25), the triarylamine derivatives (HT-1) to (HT-6) described above in the first embodiment were used as the hole transport material. The synthesis methods of these triarylamine derivatives will be described later.

Besides, in the preparation of the photosensitive members (B-1) to (B-8), a hole transport material represented by formula (HT-A) or (HT-B) was used.

(HT-A)

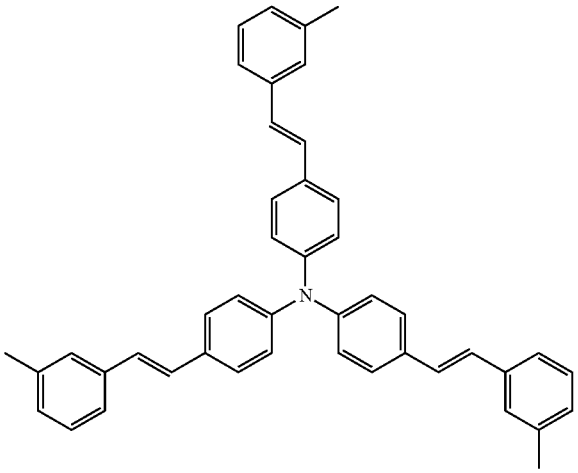

(HT-B)

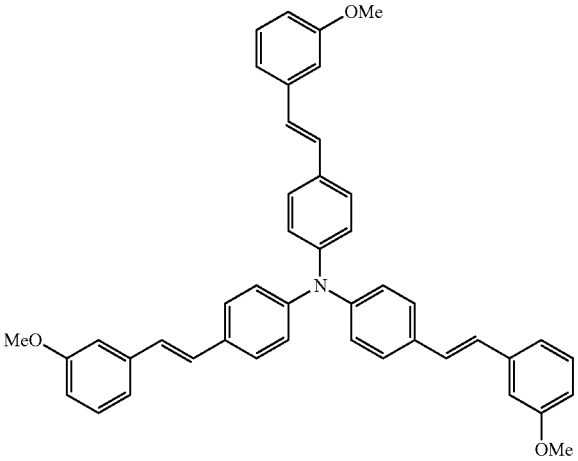

Synthesis of Triarylamine Derivative (HT-1)

First, a reaction represented by reaction formula (R-4) was performed.

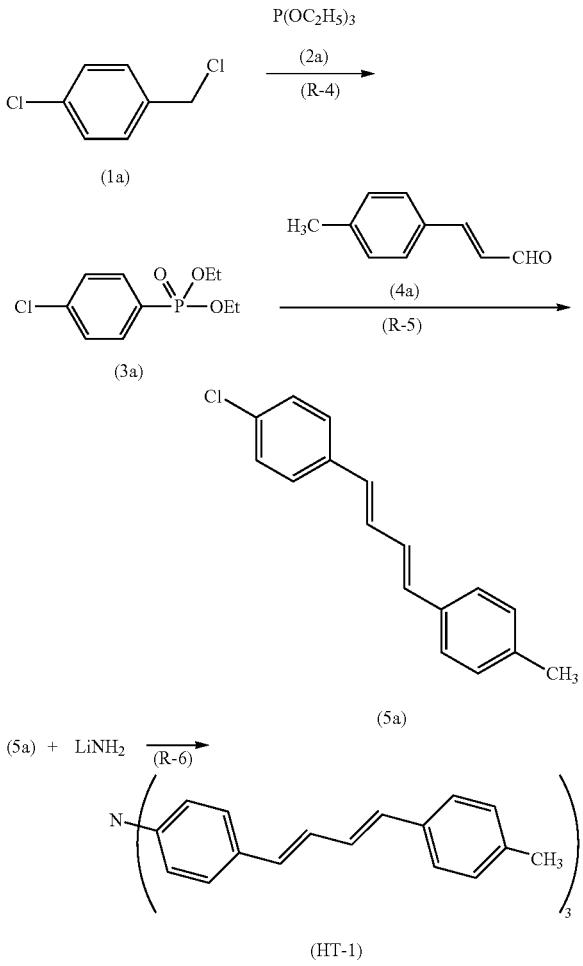

(Synthesis of Compound Represented by Chemical Formula (3a))

Specifically, a 200 mL flask was used as a reaction vessel. The reaction vessel was charged with a compound represented by chemical formula (1a) (16.1 g, 0.1 mol), and a compound (triethyl phosphite) represented by chemical formula (2a) (25 g, 0.15 mol). The resultant content of the reaction vessel was stirred at 180° C. for 8 hours. Subsequently, the content of the reaction vessel was cooled to room temperature (25° C.). Thereafter, an excessive portion of the triethyl phosphite was distilled off under reduced pressure to obtain a compound represented by chemical formula (3a) in the form of a white liquid (yield amount: 24.1 g, yield: 92 mol %).

(Synthesis of Compound Represented by Chemical Formula (5a))

Subsequently, a reaction represented by reaction formula (R-5) was performed. Specifically, a 500 mL two-necked flask was used as a reaction vessel. The reaction vessel was charged with the compound represented by chemical formula (3a) (13 g, 0.05 mol) obtained as described above. The inside atmosphere of the reaction vessel was replaced with argon gas. Thereafter, the reaction vessel was charged with dry tetrahydrofuran (100 mL) and 28% sodium methoxide (9.3 g, 0.05 mol), and the resultant content of the reaction vessel was stirred for 30 minutes. Then, a compound represented by chemical formula (4a) (7 g, 0.05 mol) in dry tetrahydrofuran (300 mL) was added to the reaction vessel, followed by stirring the content of the reaction vessel at room temperature (25° C.) for 12 hours. Subsequently, the content of the reaction vessel was poured into ion-exchanged water, and a compound represented by chemical formula (5a) was extracted with toluene. The obtained organic phase was washed with ion-exchanged water five times, and dried over anhydrous sodium sulfate, and the solvent was distilled off to obtain a residue. The obtained residue was purified by using a developing solvent to obtain a compound represented by chemical formula (5a) in the form of a white crystal (yield amount: 9.8 g, yield: 80 mol %). As the developing solvent, a mixed solvent of toluene and methanol (in a volume ratio of toluene/methanol of 20 mL/100 mL) was used.

(Synthesis of Triarylamine Derivative (HT-1))

Next, a reaction represented by reaction formula (R-6) was performed. Specifically, a three-necked flask was used as a reaction vessel. The reaction vessel was charged with the compound represented by chemical formula (5a) (8 g, 0.03 mol), tricyclohexylphosphine (0.0662 g, 0.000189 mol), tris(dibenzylideneacetone)dipalladium (0) (0.0864 g, 0.0000944 mol), sodium tert-butoxide (5.3 g, 0.06 mol), lithium amide (0.24 g, 0.010 mol), and distilled o-xylene (500 mL). The inside atmosphere of the reaction vessel was replaced with argon gas. Thereafter, the resultant content of the reaction vessel was stirred at 120° C. for 5 hours. Then, the content of the reaction vessel was cooled to room temperature. As a result, the organic phase of the content of the reaction vessel was obtained. The obtained organic phase was washed with ion-exchanged water three times. Subsequently, anhydrous sodium sulfide and activated clay were added to the organic phase, followed by a drying treatment and an adsorption treatment. Thereafter, the organic phase was distilled off under reduced pressure for removing the o-xylene to obtain a residue. The thus obtained residue was purified by column chromatography using a developing solvent to obtain a yellow powder (yield amount: 4.5 g, yield: 64 mol %). As the developing solvent, a mixed solvent of chloroform and hexane (in a volume ratio of chloroform/hexane of 1/1) was used.

The obtained yellow powder was subjected to measurement using a $^1$H-NMR spectrometer (300 MHz). $CDCl_3$ was used as a solvent. TMS was used as a standard substance. The thus obtained $^1$H-NMR chart was similar to that illustrated in FIG. 2. Thus, the obtained yellow powder was confirmed as the triarylamine derivative (HT-1). Chemical shift values of the triarylamine derivative (HT-1) were as follows:

Triarylamine derivative (HT-1): $^1$H-NMR (300 MHz, $CDCl_3$) δ=7.30-7.35 (m, 12H), 7.10-7.15 (d, 6H), 7.03-7.07 (d, 6H), 6.81-6.96 (m, 6H), 6.57-6.67 (m, 6H), 2.34 (s, 9H).

Synthesis of Triarylamine Derivative (HT-2)

A compound represented by chemical formula (5b) was obtained (yield: 70 mol %) in the same manner as in the synthesis of the compound represented by chemical formula (5a) except that the compound represented by chemical formula (4a) was replaced with a compound represented by chemical formula (4b). Subsequently, the triarylamine derivative (HT-2) was obtained (yield: 65 mol %) in the same manner as in the synthesis of the triarylamine derivative (HT-1) except that the compound represented by chemical formula (5a) was replaced with a compound represented by chemical formula (5b). A $^1$H-NMR chart similar to that of FIG. 3 was obtained, and thus, it was confirmed that the triarylamine derivative (HT-2) was thus obtained. Chemical shift values of the triarylamine derivative (HT-2) were as follows:

Triarylamine derivative (HT-2): $^1$H-NMR (300 MHz, $CDCl_3$) δ=7.30-7.38 (m, 12H), 7.17-7.20 (d, 6H), 7.01-7.10 (d, 6H), 6.81-6.96 (m, 6H), 6.57-6.65 (m, 6H), 2.84-2.95 (m, 3H), 1.25 (d, 18H).

(4b)

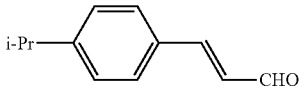

(5b)

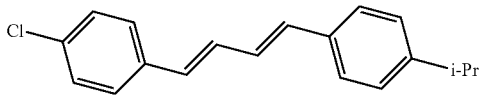

Incidentally, in the synthesis of the triarylamine derivative (HT-2) and synthesis described below of the triarylamine derivatives (HT-3) to (HT-7), the amounts of used materials and the like were controlled so that the molar scale for each of the derivatives could be equivalent to that employed in the synthesis of the triarylamine derivative (HT-1).

Synthesis of Triarylamine Derivative (HT-3)

A compound represented by chemical formula (5c) was obtained (yield: 60 mol %) in the same manner as in the synthesis of the compound represented by chemical formula (5a) except that the compound represented by chemical formula (4a) was replaced with a compound represented by chemical formula (4c). Subsequently, the triarylamine derivative (HT-3) was obtained (yield: 65 mol %) in the same manner as in the synthesis of the triarylamine derivative (HT-1) except that the compound represented by chemical formula (5a) was replaced with a compound represented by chemical formula (5c). A $^1$H-NMR chart similar to that of FIG. 4 was obtained, and thus, it was confirmed that the triarylamine derivative (HT-3) was thus obtained. Chemical shift values of the triarylamine derivative (HT-3) were as follows:

Triarylamine derivative (HT-3): $^1$H-NMR (300 MHz, $CDCl_3$) δ=7.50-7.54 (dd, 3H), 7.31-7.35 (d, 6H), 7.17-7.24 (m, 6H), 6.86-7.08 (m, 18H), 6.58-6.66 (m, 3H), 3.88 (s, 9H).

(4c)

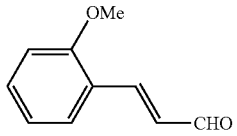

(5c)

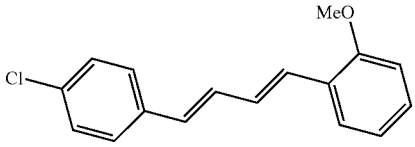

Synthesis of Triarylamine Derivative (HT-4)

A compound represented by chemical formula (5d) was obtained (yield: 70 mol %) in the same manner as in the synthesis of the compound represented by chemical formula (5a) except that the compound represented by chemical formula (4a) was replaced with a compound represented by chemical formula (4d). Subsequently, the triarylamine derivative (HT-4) was obtained (yield: 60 mol %) in the same manner as in the synthesis of the triarylamine derivative (HT-1) except that the compound represented by chemical formula (5a) was replaced with a compound represented by chemical formula (5d). A $^1$H-NMR chart similar to that of FIG. 5 was obtained, and thus, it was confirmed that the triarylamine derivative (HT-4) was thus obtained. Chemical shift values of the triarylamine derivative (HT-4) were as follows:

Triarylamine derivative (HT-4): $^1$H-NMR (300 MHz, $CDCl_3$) δ=7.17-7.34 (m, 18H), 6.81-7.07 (m, 12H), 6.58-6.64 (d, 6H), 2.35 (s, 9H).

(4d)

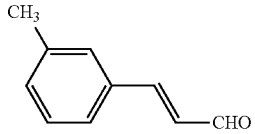

(5d)

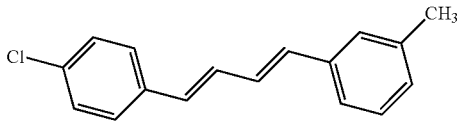

Synthesis of Triarylamine Derivative (HT-5)

A compound represented by chemical formula (5e) was obtained (yield: 70 mol %) in the same manner as in the synthesis of the compound represented by chemical formula (5a) except that the compound represented by chemical formula (4a) was replaced with a compound represented by chemical formula (4e). Subsequently, the triarylamine derivative (HT-5) was obtained (yield: 65 mol %) in the same manner as in the synthesis of the triarylamine derivative (HT-1) except that the compound represented by chemical formula (5a) was replaced with a compound represented by chemical formula (5e). A $^1$H-NMR chart similar to that of FIG. 6 was obtained, and thus, it was confirmed that the triarylamine derivative (HT-5) was thus obtained. Chemical shift values of the triarylamine derivative (HT-5) were as follows:

Triarylamine derivative (HT-5): $^1$H-NMR (300 MHz, $CDCl_3$) δ=7.21-7.35 (m, 9H), 6.76-7.10 (m, 21H), 6.58-6.66 (m, 6H), 2.34 (s, 9H).

(4e)

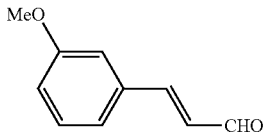

(5e)

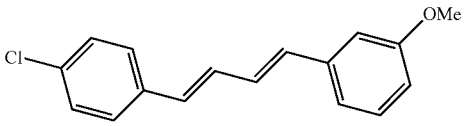

Synthesis of Triarylamine Derivative (HT-6)

A compound represented by chemical formula (5f) was obtained (yield: 50 mol %) in the same manner as in the synthesis of the compound represented by chemical formula (5a) except that the compound represented by chemical formula (3a) was replaced with a compound represented by chemical formula (3f) and that the compound represented by chemical formula (4a) was replaced with a compound represented by chemical formula (40. Subsequently, the triarylamine derivative (HT-6) was obtained (yield: 60 mol %) in the same manner as in the synthesis of the triarylamine derivative (HT-1) except that the compound represented by chemical formula (5a) was replaced with a compound represented by chemical formula (5f).

(3f)

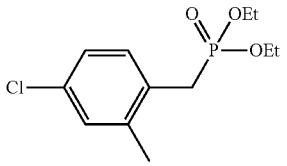

(4f)

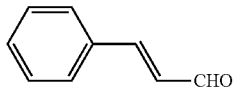

(5f)

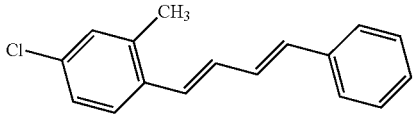

[1-3. Preparation of Electron Transport Material]

In the preparation of the photosensitive members (A-1) to (A-25) and (B-1) to (B-8), any of the compounds represented by chemical formulas (ETM-1) to (ETM-4) described above in the first embodiment was used.

[1-4. Preparation of Binder Resin]

In the preparation of the photosensitive members (A-1) to (A-25) and (B-1) to (B-8), a polycarbonate resin represented by chemical formula (Resin-1) was used.

(Resin-1)

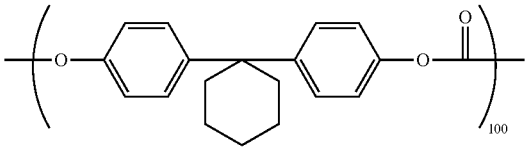

[1-5. Manufacture of Photosensitive Member (A-1)]

A vessel was charged with 5 parts by mass of X-form metal-free phthalocyanine (X—$H_2$Pc) used as the charge generating material, 50 parts by mass of the triarylamine derivative (HT-2) used as the hole transport material, 35 parts by mass of the electron transport material (ETM-1), 100 parts by mass of the polycarbonate resin ("Panlite (R) TS-2050", product of Teijin Limited, having a viscosity average molecular weight of 50,000) represented by chemical formula (Resin-1) used as the binder resin, and 800 parts by mass of tetrahydrofuran used as the solvent. These materials were mixed and dispersed by using a ball mill for 50 hours, and thus, an application liquid was prepared.

The application liquid was applied onto a conductive substrate by dip coating to form a film of the application liquid on the conductive substrate. Next, the film of the application liquid was dried at 100° C. for 40 minutes to remove tetrahydrofuran from the film. As a result, the photosensitive member (A-1) including a photosensitive layer formed on the conductive substrate was obtained. The photosensitive layer had a thickness of 30 μm.

[1-6. Manufacture of Photosensitive Members (A-2) to (A-25) and (B-1) to (B-8)]

The photosensitive members (A-2) to (A-25) and (B-1) to (B-8) were manufactured in the same manner as in the manufacture of the photosensitive member (A-1) except for the following: For each of the photosensitive members, the charge generating material (X—$H_2$Pc), the hole transport material (HT-2) and the electron transport material (ETM-3) used in the manufacture of the photosensitive member (A-1) were respectively replaced with a charge generating material, a hole transport material, and an electron transport material listed in columns of the charge generating material (CGM), the hole transport material (HTM) and the electron transport material (ETM) in Tables 1 and 2 below.

[2. Performance Evaluation of Photosensitive Members]

Each of the photosensitive members (A-1) to (A-25) and (B-1) to (B-8) was evaluated as follows.

(Evaluation of Transfer Memory)

The photosensitive member was installed in an image forming apparatus ("FS-C5250DN", product of KYOCERA Document Solutions Inc.). This image forming apparatus includes, as a charging section, a contact charging roller applying a direct current voltage. The charging roller charges the surface of the photosensitive member with a charging sleeve in contact with the photosensitive member. The charging sleeve is made of a chargeable rubber obtained by dispersing conductive carbon in an epichlorohydrin resin. Besides, this image forming apparatus adopts the intermediate transfer process.

The surface of the photosensitive member was charged by the charging roller to +600 V. A surface potential ($V_{OFF}$) of an unexposed portion of the photosensitive member obtained with no transfer bias applied thereto, and a surface potential ($V_{ON}$) of the unexposed portion of the photosensitive member obtained with a transfer bias applied thereto were respectively measured. Incidentally, the transfer bias applied here was −2 kV. The measurement was performed under an environment of a temperature of 23° C. and a relative humidity of 50%.

A difference between the measured surface potentials ($V_{ON}$−$V_{OFF}$) was calculated. The calculated difference in the surface potential was defined as a transfer memory potential. Incidentally, a larger absolute value of the difference in the surface potential implies the occurrence of the transfer memory.

The transfer memory of the photosensitive members (A-1), (A-5), (A-9) and (A-13) of Examples 26 to 29, and the photosensitive members (B-1) and (B-5) of Comparative Examples 9 and 10 was evaluated in the same manner as in the above-described evaluation of the transfer memory performed with a direct current voltage applied by the charging section except that the image forming apparatus in which each of these photosensitive members was installed included, as the charging section, a contact charging roller applying an alternating current voltage.

(Evaluation of Image defect)

Each of the photosensitive members (A-1) to (A-25) of Examples 1 to 25, and the photosensitive members (B-1) to (B-8) of Comparative Examples 1 to 8 was installed in an image forming apparatus ("FS-C5250DN", product of KYOCERA Document Solutions Inc.). This image forming apparatus includes, as a charging section, a contact charging roller applying a direct current voltage. The charging roller charges the surface of the photosensitive member with a charging sleeve in contact with the photosensitive member. The charging sleeve is made of a chargeable rubber obtained by dispersing conductive carbon in an epichlorohydrin resin. Besides, this image forming apparatus adopts the intermediate transfer process. For stabilizing an operation of the photosensitive member of the image forming apparatus, an image of alphabets was printed for 1 hour. Subsequently, an image A was printed on 1 sheet. The image A was formed during the first rotation of the photosensitive member after performing the printing operation for 1 hour. The image A was an image including a doughnut-shaped outline pattern. The doughnut-shaped outline pattern consisted of a pair of concentric circles. An image-formed portion of the image A had an image density of 100%. The length in the printing direction of the image A corresponds to the circumferential length of the photosensitive member. Subsequently, an entire halftone image B (with an image density of 12.5%) was printed on 1 sheet. The image B was formed during the second rotation of the photosensitive member after forming the image A. The image B thus formed was used as an evaluation sample for an image ghost. The length in the printing direction of the image B corresponds to the circumferential length of the photosensitive member.

The thus obtained evaluation sample was visually observed to determine whether or not an image ghost derived from the image A was observed. The presence of an image ghost was evaluated based on the following criteria. Incidentally, a photosensitive member evaluated as A or B was determined as acceptable.

A: An image ghost derived from the image A was not observed.

B: An image ghost derived from the image A was slightly observed.

C: An image ghost derived from the image A was observed. In the evaluation sample, contrast between the observed image ghost and a non-image-formed portion where no image ghost was observed was low.

D: An image ghost derived from the image A was clearly observed. In the evaluation sample, contrast between the observed image ghost and a non-image-formed portion where no image ghost was observed was high.

An image defect of the photosensitive members (A-1), (A-5), (A-9) and (A-13) of Examples 26 to 29, and the photosensitive members (B-1) and (B-5) of Comparative Examples 9 and 10 was evaluated in the same manner as in the above-described evaluation of the image defect performed with a direct current voltage applied by the charging section except that the image forming apparatus in which each of these photosensitive members was installed included, as the charging section, a contact charging roller applying an alternating current voltage.

TABLE 1

| Example | Photosensitive Member | HTM | ETM | CGM | Transfer Memory Potential (V) | Image Evaluation |
|---|---|---|---|---|---|---|
| 1 | A-1 | HT-2 | ETM-3 | X-$H_2$Pc | −11 | A |
| 2 | A-2 | HT-2 | ETM-1 | X-$H_2$Pc | −10 | A |
| 3 | A-3 | HT-2 | ETM-2 | X-$H_2$Pc | −13 | A |
| 4 | A-4 | HT-2 | ETM-4 | X-$H_2$Pc | −10 | A |
| 5 | A-5 | HT-4 | ETM-3 | X-$H_2$Pc | −9 | A |
| 6 | A-6 | HT-4 | ETM-1 | X-$H_2$Pc | −11 | A |
| 7 | A-7 | HT-4 | ETM-2 | X-$H_2$Pc | −11 | A |
| 8 | A-8 | HT-4 | ETM-4 | X-$H_2$Pc | −12 | A |
| 8 | A-9 | HT-5 | ETM-3 | X-$H_2$Pc | −11 | A |
| 10 | A-10 | HT-5 | ETM-1 | X-$H_2$Pc | −12 | A |
| 11 | A-11 | HT-5 | ETM-2 | X-$H_2$Pc | −11 | A |
| 12 | A-12 | HT-5 | ETM-4 | X-$H_2$Pc | −9 | A |
| 13 | A-13 | HT-1 | ETM-3 | X-$H_2$Pc | −7 | A |
| 14 | A-14 | HT-1 | ETM-1 | X-$H_2$Pc | −9 | A |
| 15 | A-15 | HT-1 | ETM-2 | X-$H_2$Pc | −9 | A |
| 16 | A-16 | HT-1 | ETM-4 | X-$H_2$Pc | −9 | B |
| 17 | A-17 | HT-3 | ETM-3 | X-$H_2$Pc | −8 | B |
| 18 | A-18 | HT-3 | ETM-1 | X-$H_2$Pc | −10 | A |
| 19 | A-19 | HT-3 | ETM-2 | X-$H_2$Pc | −10 | A |
| 20 | A-20 | HT-3 | ETM-4 | X-$H_2$Pc | −10 | A |
| 21 | A-21 | HT-6 | ETM-3 | X-$H_2$Pc | −9 | A |
| 22 | A-22 | HT-6 | ETM-1 | X-$H_2$Pc | −10 | B |
| 23 | A-23 | HT-6 | ETM-2 | X-$H_2$Pc | −10 | A |
| 24 | A-24 | HT-6 | ETM-4 | X-$H_2$Pc | −10 | A |
| 25 | A-25 | HT-2 | ETM-3 | TiOPc | −12 | A |
| 26 | A-1 | HT-2 | ETM-3 | X-$H_2$Pc | −10 | A |
| 27 | A-5 | HT-4 | ETM-3 | X-$H_2$Pc | −8 | A |
| 28 | A-9 | HT-5 | ETM-3 | X-$H_2$Pc | −11 | A |
| 29 | A-13 | HT-1 | ETM-3 | X-$H_2$Pc | −12 | A |

TABLE 2

| Comparative Example | Photosensitive Member | HTM | ETM | CGM | Transfer Memory Potential (V) | Image Evaluation |
|---|---|---|---|---|---|---|
| 1 | B-1 | HT-A | ETM-3 | X-$H_2$Pc | −50 | D |
| 2 | B-2 | HT-A | ETM-1 | X-$H_2$Pc | −49 | D |
| 3 | B-3 | HT-A | ETM-2 | X-$H_2$Pc | −50 | D |
| 4 | B-4 | HT-A | ETM-4 | X-$H_2$Pc | −52 | D |
| 5 | B-5 | HT-B | ETM-3 | X-$H_2$Pc | −56 | D |
| 6 | B-6 | HT-B | ETM-1 | X-$H_2$Pc | −53 | D |
| 7 | B-7 | HT-B | ETM-2 | X-$H_2$Pc | −54 | D |
| 8 | B-8 | HT-B | ETM-4 | X-$H_2$Pc | −54 | D |
| 9 | B-1 | HT-A | ETM-3 | X-$H_2$Pc | −25 | C |
| 10 | B-5 | HT-B | ETM-3 | X-$H_2$Pc | −23 | C |

As shown in Tables 1 and 2, the transfer memory potentials, obtained under the charging condition of applying a direct current voltage, of the photosensitive members (A-1) to (A-25) of Examples 1 to 25 were −13 V or more and −8 V or less. The transfer memory potentials, obtained under the charging condition of applying a direct current voltage, of the photosensitive members (B-1) to (B-8) of Comparative Examples 1 to 8 were −56 V or more and −49 V or less. Thus, it was revealed that the photosensitive members (A-1) to (A-25) containing the triarylamine derivatives (I) inhibit the occurrence of the transfer memory under the charging condition of applying a direct current voltage as compared with the photosensitive members (B-1) to (B-8).

Besides, as shown in Tables 1 and 2, the images formed, under the charging condition of applying a direct current voltage, by the image forming apparatuses respectively including the photosensitive members (A-1) to (A-25) were evaluated as A or B. The images formed, under the charging condition of applying a direct current voltage, by the image forming apparatuses respectively including the photosensitive members (B-1) to (B-8) of Comparative Examples 9 and 10 were all evaluated as D. Thus, it was revealed that the occurrence of an image ghost is inhibited under the charging condition of applying a direct current voltage in the image forming apparatuses respectively including the photosensitive members (A-1) to (A-25) as compared with that in the image forming apparatuses respectively including the photosensitive members (B-1) to (B-8).

As shown in Tables 1 and 2, the transfer memory potentials, obtained under the charging condition of applying an alternating current voltage, of the photosensitive members (A-1), (A-5), (A-9), and (A-13) of Examples 26 to 29 were −12 V or more and −8 V or less. The transfer memory potentials, obtained under the charging condition of applying an alternating current voltage, of the photosensitive members (B-1) and (B-5) of Comparative Examples 9 and 10 were −25 V or more and −23 V or less. Thus, it was revealed that the photosensitive members (A-1), (A-5), (A-9), and (A-13) containing the triarylamine derivatives (I) inhibit the occurrence of the transfer memory under the charging condition of applying an alternating current voltage as compared with the photosensitive members (B-1) and (B-5).

Besides, as shown in Tables 1 and 2, the images formed, under the charging condition of applying an alternating current voltage, by the image forming apparatuses respectively including the photosensitive members (A-1), (A-5), (A-9), and (A-13) were all evaluated as A. The images formed, under the charging condition of applying an alternating current voltage, by the image forming apparatuses respectively including the photosensitive members (B-1) and (B-5) of Comparative Examples 9 and 10 were all evaluated as C. Thus, it was revealed that the occurrence of an image ghost is inhibited under the charging condition of applying an alternating current voltage in the image forming apparatuses respectively including the photosensitive members (A-1), (A-5), (A-9), and (A-13) as compared with that in the image forming apparatuses respectively including the photosensitive members (B-1) and (B-5).

As a result, it was obvious that the photosensitive member of the present disclosure inhibits the occurrence of the transfer memory, and that the image forming apparatus including this photosensitive member inhibits the occurrence of an image defect.

Furthermore, the photosensitive members (A-1) to (A-25) of Examples 1 to 29 were evaluated for the abrasion resistance. The photosensitive members (A-1) to (A-25) of Examples 1 to 25 used under the charging condition of applying a direct current voltage were less abrasive than the photosensitive members (A-1), (A-5), (A-9), and (A-13) of Examples 26 to 29 used under the charging condition of applying an alternating current voltage.

What is claimed is:

1. A process cartridge comprising a positively chargeable single-layer electrophotographic photosensitive member, wherein the positively chargeable single-layer electrophotographic photosensitive member includes a conductive substrate and a photosensitive layer, the photosensitive layer contains at least a charge generating material, a hole transport material, an electron transport material, and a binder resin, the hole transport material contains a triarylamine derivative represented by general formula (I) shown below, and the electron transport material contains a compound represented by general formula (ETM-IV) shown below, (I)

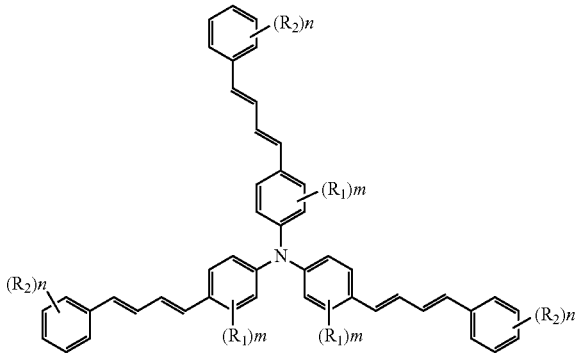

wherein $R_1$ and $R_2$ each independently represent an alkyl group having a carbon number of at least 1 and no greater than 6 or an alkoxy group having a carbon number of at least 1 and no greater than 6, m and n each independently represent an integer of 0 or more and 4 or less, if m represents an integer of 2 or more, a plurality of $R_1$s present on the same aromatic ring may be the same as or different from one another, if n represents an integer of 2 or more, a plurality of $R_2$s present on the same aromatic ring may be the same as or different from one another, (ETM-IV)

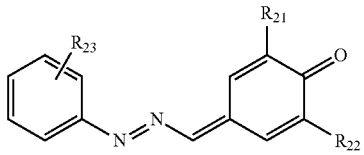

wherein $R_{21}$ and $R_{22}$ each independently represent a hydrogen atom, an optionally substituted alkyl group having a carbon number of at least 1 and no greater than 10, an optionally substituted alkenyl group having a carbon number of at least 2 and no greater than 10, an optionally substituted alkoxy group having a carbon number of at least 1 and no greater than 10, an optionally substituted aralkyl group having a carbon number of at least 7 and no greater than 15, an optionally substituted aryl group having a carbon number of at least 6 and no greater than 14, or an optionally substituted heterocyclic group, and $R_{23}$ represents a halogen atom, a hydrogen atom, an optionally substituted alkyl group having a carbon number of at least 1 and no greater than 10, an optionally substituted alkenyl group having a carbon number of at least 2 and no greater than 10, an optionally substituted alkoxy group having a carbon number of at least 1 and no greater than 10, an optionally substituted aralkyl group having a carbon number of at least 7 and no greater than 15, an optionally substituted aryl group having a carbon number of at least 6 and no greater than 14, or an optionally substituted heterocyclic group.

2. An image forming apparatus comprising:

an image bearing member;

a charging section configured to charge a surface of the image bearing member;

a light exposure section configured to form an electrostatic latent image on the surface of the image bearing member;

a developing section configured to develop the electrostatic latent image into a toner image; and a transfer section configured to transfer the toner image from the image bearing member onto a transfer target, wherein the charging section is configured to be in contact with the image bearing member to apply a voltage thereto, the charging section has a positive charging polarity, the image bearing member is a positively chargeable single-layer electrophotographic photosensitive member including a conductive substrate and a photosensitive layer, the photosensitive layer contains at least a charge generating material, a hole transport material, an electron transport material, and a binder resin, the hole transport material contains a triarylamine derivative represented by general formula (I) shown below, and the electron transport material contains a compound represented by general formula (ETM-IV) shown below, (I)

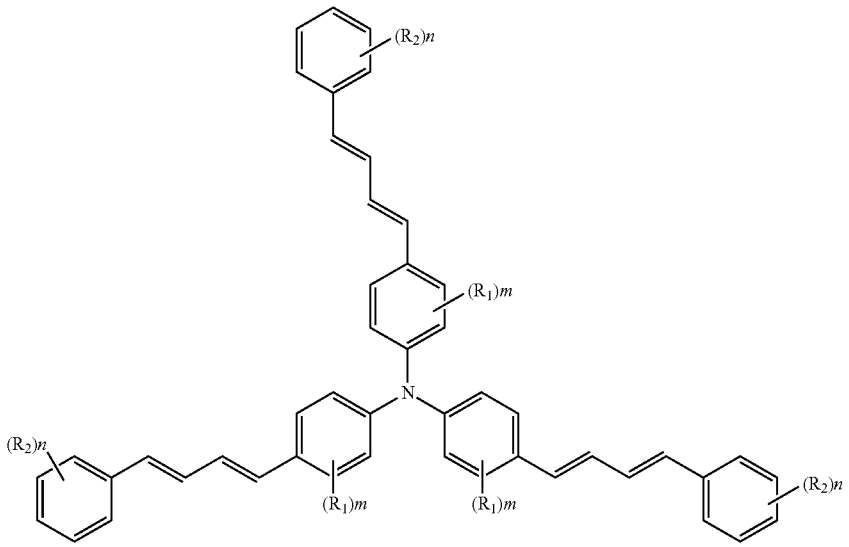

wherein $R_1$ and $R_2$ each independently represent an alkyl group having a carbon number of at least 1 and no greater than 6 or an alkoxy group having a carbon number of at least 1 and no greater than 6, m and n each independently represent an integer of 0 or more and 4 or less, if m represents an integer of 2 or more, a plurality of $R_1$s present on the same aromatic ring may be the same as or different from one another, if n represents an integer of 2 or more, a plurality of $R_2$s present on the same aromatic ring may be the same as or different from one another, (ETM-IV)

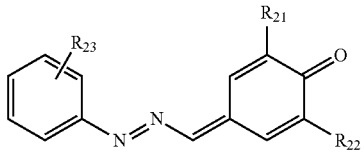

wherein $R_{21}$ and $R_{22}$ each independently represent a hydrogen atom, an optionally substituted alkyl group having a carbon number of at least 1 and no greater than 10, an optionally substituted alkenyl group having a carbon number of at least 2 and no greater than 10, an optionally substituted alkoxy group having a carbon number of at least 1 and no greater than 10, an optionally substituted aralkyl group having a carbon number of at least 7 and no greater than 15, an optionally substituted aryl group having a carbon number of at least 6 and no greater than 14, or an optionally substituted heterocyclic group, and $R_{23}$ represents a halogen atom, a hydrogen atom, an optionally substituted alkyl group having a carbon number of at least 1 and no greater than 10, an optionally substituted alkenyl group having a carbon number of at least 2 and no greater than 10, an optionally substituted alkoxy group having a carbon number of at least 1 and no greater than 10, an optionally substituted aralkyl group having a carbon number of at least 7 and no greater than 15, an optionally substituted aryl group having a carbon number of at least 6 and no greater than 14, or an optionally substituted heterocyclic group.

3. The image forming apparatus according to claim 2, wherein the voltage is a direct current voltage.

4. The image forming apparatus according to claim 2, wherein, in general formula (I), $R_1$ and $R_2$ each independently represent an alkyl group having a carbon number of at least 1 and no greater than 3, or a methoxy group, and m and n each independently represent 0 or 1.

5. The image forming apparatus according to claim 2, wherein, in general formula (ETM-IV), $R_{21}$ and $R_{22}$ each independently represent an alkyl group having a carbon number of at least 1 and no greater than 5, and $R_{23}$ represents a halogen atom.

6. The image forming apparatus according to claim 2, wherein the electron transport material is represented by the following chemical formula (ETM-4)

(ETM-4)

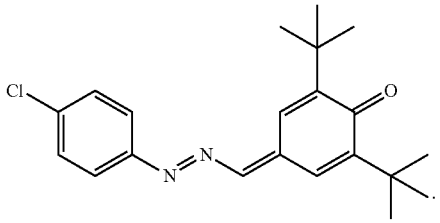

7. The image forming apparatus according to claim 2, wherein the triarylamine derivative is represented by the following chemical formulas (HT-1), (HT-2), (HT-3), (HT-4), (HT-5), (HT-6), or (HT-7)

(HT-1)

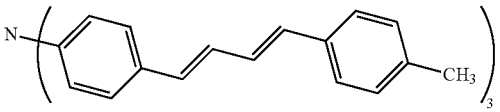

(HT-2)

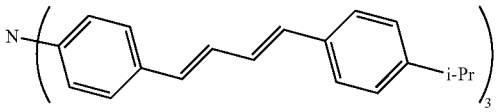

-continued (HT-3)

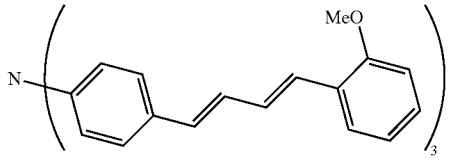

(HT-4)

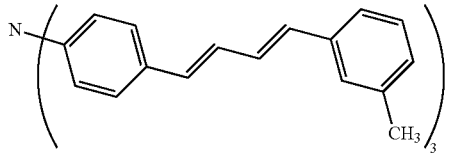

(HT-5)

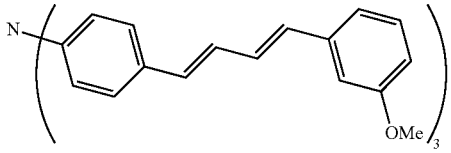

(HT-6)

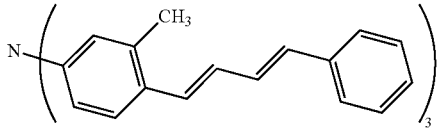

(HT-7)

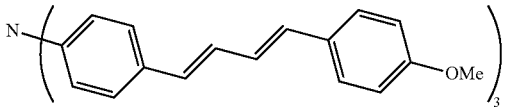

* * * * *